US008771038B2

(12) United States Patent
Kimba et al.

(10) Patent No.: US 8,771,038 B2
(45) Date of Patent: Jul. 8, 2014

(54) POLISHING APPARATUS

(75) Inventors: Toshifumi Kimba, Toyko (JP); Hiroaki Kusa, Toyko (JP); Masaki Fujii, Kanagawa-ken (JP)

(73) Assignee: Ebara Corporation, Tokyo (JP)

( * ) Notice: Subject to any disclaimer, the term of this patent is extended or adjusted under 35 U.S.C. 154(b) by 1215 days.

(21) Appl. No.: 12/668,065

(22) PCT Filed: Jun. 24, 2008

(86) PCT No.: PCT/JP2008/061932

§ 371 (c)(1),
(2), (4) Date: Sep. 27, 2010

(87) PCT Pub. No.: WO2009/008293

PCT Pub. Date: Jan. 15, 2009

(65) Prior Publication Data

US 2011/0034106 A1 Feb. 10, 2011

(30) Foreign Application Priority Data

Jul. 11, 2007 (JP) ..... 2007-182065

(51) Int. Cl.
*B24B 49/12* (2006.01)
*B24B 9/06* (2006.01)
*B24B 37/005* (2012.01)

(52) U.S. Cl.
CPC ..... *B24B 49/12* (2013.01); *B24B 9/065* (2013.01); *B24B 37/005* (2013.01)
USPC ..... 451/6; 451/173

(58) Field of Classification Search
USPC ..... 451/44, 168, 173, 6
See application file for complete search history.

(56) References Cited

U.S. PATENT DOCUMENTS 6,000,996 A 12/1999 Fujiwara
6,604,985 B2 * 8/2003 Muilenburg et al. ..... 451/6

(Continued)

FOREIGN PATENT DOCUMENTS

JP 7-256550 10/1995
JP 10-223578 8/1998

(Continued)

OTHER PUBLICATIONS

Supplementary European Search Report issued Dec. 6, 2012 in corresponding European Patent Application No. 08765858.9.

(Continued)

*Primary Examiner* — Robert Rose
(74) *Attorney, Agent, or Firm* — Wenderoth, Lind & Ponack, L.L.P.

(57) ABSTRACT

A polishing apparatus includes a stage configured to hold a substrate, a stage-rotating mechanism configured to rotate the stage, and a polishing head configured to polish a periphery of the substrate held by the stage. The polishing apparatus also includes a controller configured to control operations of the stage, the stage-rotating mechanism, and the polishing head, an image-capturing device configured to capture an image of the periphery of the substrate through at least one terminal imaging element arranged so as to face the periphery of the substrate, an image processor configured to process the image captured by the image-capturing device, and a liquid ejector configured to eject a light-transmissive liquid toward the periphery of the substrate to fill a space between the periphery of the substrate and the terminal imaging element with the liquid.

8 Claims, 23 Drawing Sheets

(56) References Cited

U.S. PATENT DOCUMENTS

| | | | | |
|---|---|---|---|---|
| 6,621,584 | B2 * | 9/2003 | Pecen et al. | 451/303 |
| 2004/0106363 | A1 | 6/2004 | Ishii et al. | |
| 2009/0117828 | A1 | 5/2009 | Hongo et al. | |

FOREIGN PATENT DOCUMENTS

| | | |
|---|---|---|
| JP | 2003-234314 | 8/2003 |
| JP | 2003-273046 | 9/2003 |
| JP | 2005-191179 | 7/2005 |
| JP | 2007-524231 | 8/2007 |

OTHER PUBLICATIONS

International Search Report issued Sep. 16, 2008 in International (PCT) Application No. PCT/JP2008/061932.

* cited by examiner

POLISHING APPARATUS

TECHNICAL FIELD

The present invention relates to a polishing apparatus having a polishing tape, and more particularly to a polishing apparatus for polishing a periphery of a substrate, such as a semiconductor wafer.

BACKGROUND ART

From a viewpoint of improving a yield in semiconductor fabrications, management of a surface condition in a bevel portion of a wafer has recently been receiving attention. In semiconductor device fabrication processes, a number of materials are deposited on an entire surface of a wafer. As a result, these materials are formed as films on a bevel portion which is not used for products. These unwanted materials may come off the bevel portion onto devices formed on the wafer during transporting of the wafer or during various processes, resulting in a lowered yield in products.

Thus, a polishing apparatus has been widely used to remove the films formed on the bevel portion of the wafer. A typical example of the polishing apparatus of this type is a polishing apparatus configured to press a polishing tape against the bevel portion of the wafer to polish the bevel portion. More specifically, the polishing apparatus has a press pad arranged at a rear side of the polishing tape and presses a polishing surface of the polishing tape against the bevel portion of the substrate by the press pad to thereby polish the bevel portion.

In recent years, a technique of detecting a polishing end point from an image of a surface of the bevel portion captured by an imaging device (e.g., a CCD camera) during polishing has been developed. In this technique, in order to accurately detect the polishing end point, it is necessary to capture as clear an image as possible. However, in a typical bevel polishing process, a polishing liquid (e.g., pure water) is supplied to the bevel portion during polishing in order to protect a surface of the wafer from contamination by particles. This polishing liquid is likely to adhere to an objective lens of the imaging device, making it difficult to capture a clear image of the bevel portion. As a result, accurate detection of the polishing end point cannot be performed.

SUMMARY OF THE INVENTION

The present invention has been made in view of the above drawbacks. It is therefore an object of the present invention to provide a polishing apparatus capable of capturing a clear image of a periphery of a substrate and detecting an accurate polishing end point.

In order to solve the above drawbacks, one aspect of the present invention is to provide a polishing apparatus including: a stage configured to hold a substrate; a stage-rotating mechanism configured to rotate the stage; a polishing head configured to polish a periphery of the substrate held by the stage; a controller configured to control operations of the stage, the stage-rotating mechanism, and the polishing head; an image-capturing device configured to capture an image of the periphery of the substrate through at least one terminal imaging element arranged so as to face the periphery of the substrate; an image processor configured to process the image captured by the image-capturing device; and a liquid ejector configured to eject a light-transmissive liquid toward the periphery of the substrate to fill a space between the periphery of the substrate and the terminal imaging element with the liquid.

In a preferred aspect of the present invention, a flow velocity of the liquid ejected from the liquid ejector is not less than a speed of the periphery of the rotating substrate.

In a preferred aspect of the present invention, the terminal imaging element and the liquid ejector are configured to be tiltable with respect to a surface of the substrate held by the stage.

In a preferred aspect of the present invention, the at least one terminal imaging element comprises plural terminal imaging elements, and the plural terminal imaging elements are arranged so as to face an upper portion, a central portion, and a lower portion of the periphery of the substrate held by the stage.

In a preferred aspect of the present invention, the liquid ejector has an ejection hole for ejecting the liquid toward the periphery of the substrate at an angle ranging from 0 degree to 90 degrees with respect to a tangential direction of the substrate.

In a preferred aspect of the present invention, the ejection hole ejects the liquid at an angle ranging from 25 degrees to 45 degrees with respect to the tangential direction of the substrate.

In a preferred aspect of the present invention, the liquid ejector has a first ejection hole for ejecting the liquid toward the periphery of the substrate at an angle of 90 degrees with respect to a tangential direction of the substrate and a second ejection hole for ejecting the liquid toward the periphery of the substrate at an angle ranging from 25 degrees to 45 degrees with respect to the tangential direction of the substrate.

Another aspect of the present invention is to provide a polishing apparatus including: a stage configured to hold a substrate; a stage-rotating mechanism configured to rotate the stage; a polishing head configured to polish a periphery of the substrate held by the stage; a controller configured to control operations of the stage, the stage-rotating mechanism, and the polishing head; an image-capturing device configured to capture an image of the periphery of the substrate through at least one terminal imaging element arranged so as to face the periphery of the substrate; an image processor configured to process the image captured by the image-capturing device; and a contact head configured to bring a contact member into contact with the periphery of the substrate. The contact member is arranged between the periphery of the substrate and the terminal imaging element and has a light-transmissive property.

In a preferred aspect of the present invention, the terminal imaging element and the contact head are configured to be tiltable with respect to a surface of the substrate held by the stage.

In a preferred aspect of the present invention, the contact member comprises a light-transmissive transparent tape, and the contact head includes a press pad arranged at a rear side of the transparent tape and a press mechanism configured to cause the press pad to press the transparent tape against the periphery of the substrate.

In a preferred aspect of the present invention, the polishing apparatus further includes an illuminator configured to illuminate the periphery of the substrate. The terminal imaging element is arranged in a position away from a light of the illuminator reflected from the transparent tape.

In a preferred aspect of the present invention, the illuminator and the terminal imaging element are oriented in the same direction and are constructed integrally.

In a preferred aspect of the present invention, the terminal imaging element is arranged so as to face a portion of the transparent tape where highest contact pressure is applied to the periphery of the substrate.

In a preferred aspect of the present invention, the transparent tape has a cleaning function for wiping the periphery of the substrate or a polishing function for polishing the periphery of the substrate.

In a preferred aspect of the present invention, the image processor is configured to analyze a surface roughness of the periphery of the substrate from the image captured by the image-capturing device, express a distribution of the surface roughness as a numerical value, and judge that a polishing end point is reached when the numerical value exceeds or falls below a preset threshold value.

In a preferred aspect of the present invention, the image processor is configured to judge that the polishing end point is reached when a period of time in which the numerical value is greater than or smaller than the preset threshold value exceeds a preset period of time.

In a preferred aspect of the present invention, the image processor is configured to express as a numerical value a color of the image captured by the image-capturing device, and judge that a polishing end point is reached when the numerical value exceeds or falls below a preset threshold value.

In a preferred aspect of the present invention, the image processor is configured to judge that the polishing end point is reached when a period of time in which the numerical value is greater than or smaller than the preset threshold value exceeds a preset period of time.

In a preferred aspect of the present invention, the image-capturing device comprises a CCD camera, and an exposure time of the CCD camera is longer than a time when the substrate makes one revolution.

Still another aspect of the present invention is to provide a polishing apparatus including: a polishing tape having a polishing surface; a stage configured to hold a substrate; a stage-rotating mechanism configured to rotate the stage; a polishing head configured to polish a periphery of the substrate by bringing the polishing tape into contact with the periphery of the substrate; a controller configured to control operations of the stage, the stage-rotating mechanism, and the polishing head; an image-capturing device configured to capture an image of the polishing surface of the polishing tape that has contacted the substrate, through a terminal imaging element arranged so as to face the polishing surface; and an image processor configured to process the image captured by the image-capturing device.

According to the present invention, a good visibility of the terminal imaging element can be maintained by the light-transmissive liquid or the contact member. Therefore, a clear image of the periphery of the substrate can be obtained. As a result, an accurate polishing end point detection can be realized.

DETAILED DESCRIPTION OF THE INVENTION

Figure 1:
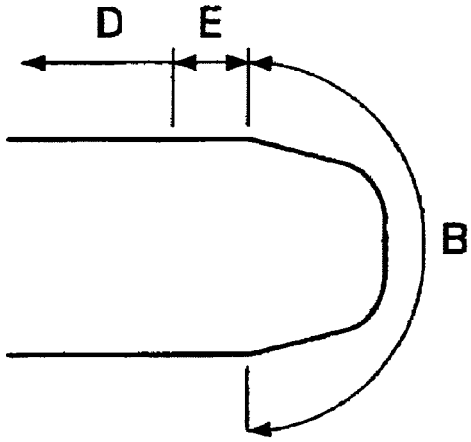
FIG. 1 is a cross-sectional view showing a periphery of a substrate.

A polishing apparatus according to embodiments of the present invention will be described below with reference to the drawings. The polishing apparatus according to embodiments of the present invention is preferably used for the purpose of polishing a periphery (a bevel portion and an edge-cut portion) of a substrate, such as a wafer. In this specification, a bevel portion is, as shown in FIG. 1, a portion B where a cross section of a periphery of a substrate has a curvature. A flat section indicated by a symbol D in FIG. 1 is a region where devices are formed. A flat portion E extending outwardly from the device region D by several millimeters is referred to as an edge-cut portion, which is distinguished from the device region D.

Figure 2:
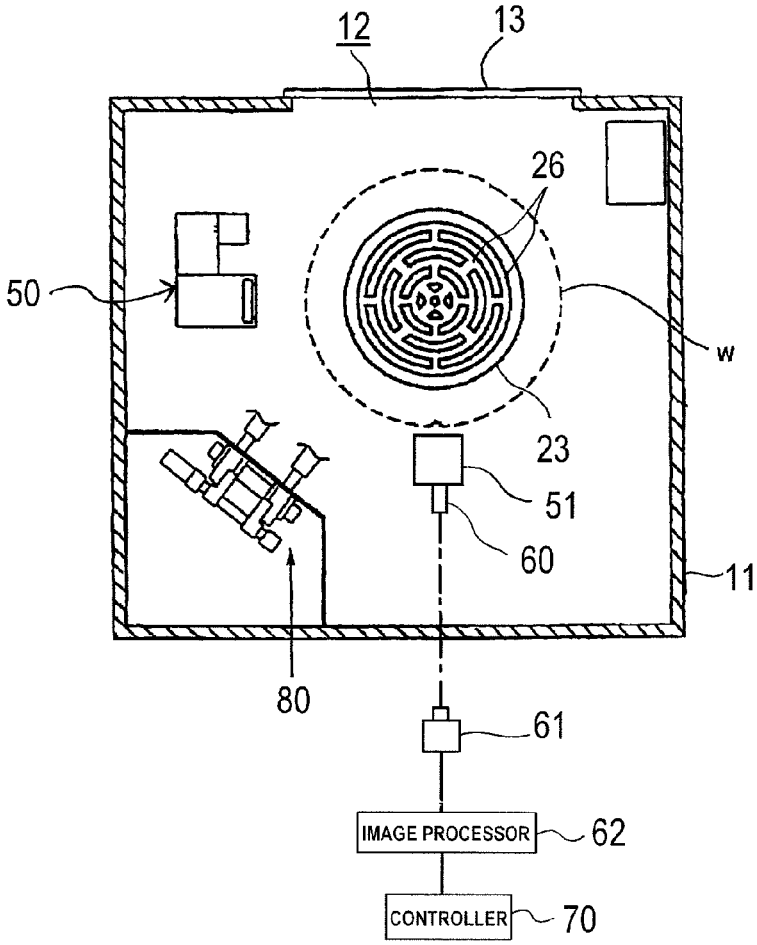
FIG. 2 is a plan view showing a polishing apparatus according to a first embodiment of the present invention.
Figure 3:
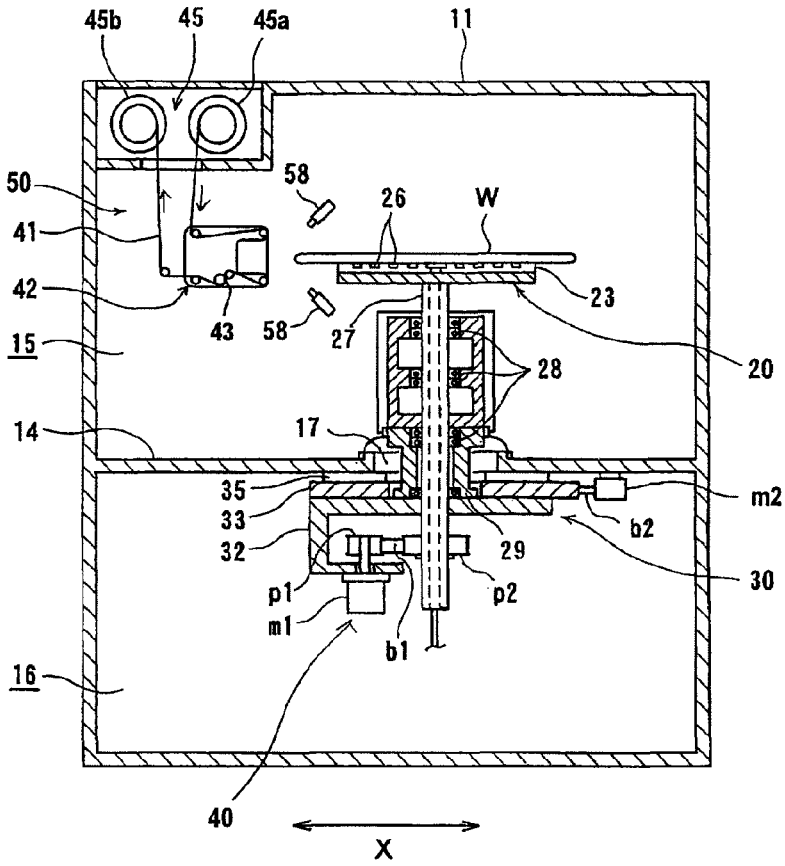
FIG. 3 is a cross-sectional view of the polishing apparatus shown in FIG. 2.

FIG. 2 is a plan view showing a polishing apparatus according to a first embodiment of the present invention. FIG. 3 is a cross-sectional view of the polishing apparatus shown in FIG. 2.

As shown in FIG. 2 and FIG. 3, the polishing apparatus according to the present embodiment includes a wafer stage unit 20 having a wafer stage 23 for holding a wafer (substrate) W, a stage-moving mechanism 30 configured to move the wafer stage unit 20 in a direction parallel to an upper surface (i.e., a wafer holding surface) of the wafer stage 23, a stage-rotating mechanism 40 configured to rotate the wafer stage 23, and a polishing unit 50 configured to polish a periphery of the wafer W held by the wafer stage 23.

As shown in FIG. 2, the polishing apparatus further includes a water ejector (liquid ejector) 51 for ejecting pure water (i.e., a transparent liquid) onto the periphery of the wafer W held by the wafer stage 23, a terminal imaging element (e.g., an objective lens) 60 secured to the water ejector 51, a CCD camera (i.e., an image-capturing device) 61 configured to capture an image of the periphery of the wafer W through the terminal imaging element 60, an image processor 62 configured to process the image from the CCD camera 61, and a controller 70 configured to control operations of the polishing apparatus based on signal from the image processor 62. Instead of the CCD camera, a digital camera using other type of light-receiving element may be used as the image-capturing device 61. Further, a micro CCD camera may be used as the image-capturing device, and the terminal imaging element and the image-capturing device may be provided integrally.

The wafer stage unit 20, the stage-moving mechanism 30, the stage-rotating mechanism 40, and the polishing unit 50 are contained in a housing 11. This housing 11 is partitioned by a partition plate 14 into two spaces: an upper chamber (a polishing chamber) 15 and a lower chamber (a mechanical chamber) 16. The above-mentioned wafer stage 23 and the polishing unit 50 are located in the upper chamber 15, and the stage-moving mechanism 30 and the stage-rotating mechanism 40 are located in the lower chamber 16. The upper chamber 15 has a side wall with an opening 12. This opening 12 is closed by a shutter 13 which is actuated by an air cylinder (not shown). The wafer W is transported into and from the housing 11 through the opening 12. Transporting of the wafer W is performed by a known wafer transport mechanism (not shown), such as a transfer robot hand.

The upper surface of the wafer stage 23 has a plurality of grooves 26. These grooves 26 are in communication with a vacuum pump (not shown) via a vertically extending hollow shaft 27. When the vacuum pump is operated, a vacuum is produced in the grooves 26, whereby the wafer W is held on the upper surface of the wafer stage 23. The hollow shaft 27 is rotatably supported by bearings 28, and the hollow shaft 27 is coupled to a motor m1 via pulleys p1, p2, and a belt b1. With these configurations, the wafer W is rotated by the motor m1, while being held on the upper surface of the wafer stage 23. The hollow shaft 27, the pulleys p1, p2, the belt b1, and the motor m1 constitute the stage-rotating mechanism 40.

The polishing apparatus further includes a wafer-chucking mechanism 80 disposed in the housing 11. The wafer-chucking mechanism 80 is configured to receive the wafer W, which has been transported into the housing 11 by the above-mentioned wafer transport mechanism, and place the wafer W onto the wafer stage 23. Further, the wafer-chucking mechanism 80 is configured to remove the wafer W from the wafer stage 23 and transport the wafer W to the above-mentioned wafer transport mechanism. Only part of the wafer-chucking mechanism 80 is shown in FIG. 2.

Figure 4:
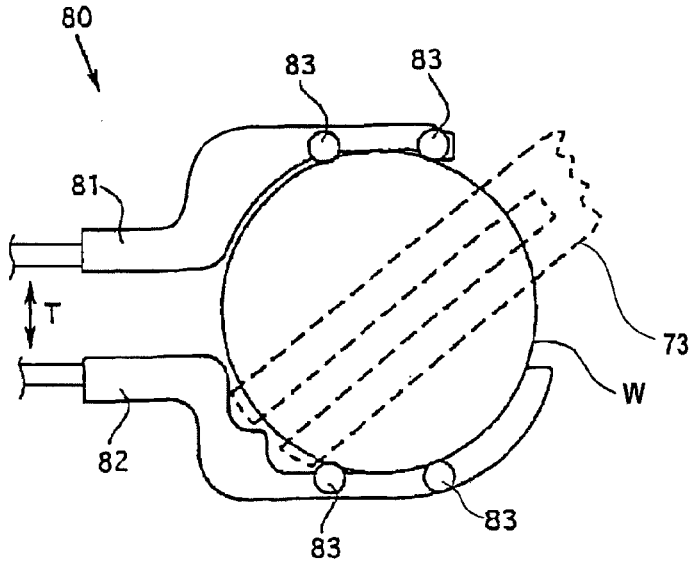
FIG. 4 is a plan view showing chuck hands of a wafer-chucking mechanism.

FIG. 4 is a plan view showing chuck hands of the wafer-chucking mechanism 80. As shown in FIG. 4, the wafer-chucking mechanism 80 has a first chuck hand 81 having a plurality of cylindrical hooks 83 and a second chuck hand 82 having a plurality of cylindrical hooks 83. These first chuck hand 81 and second chuck hand 82 are moved closer to and away from each other (as indicated by arrows T) by an opening and closing mechanism (not shown). Further, the first chuck hand 81 and the second chuck hand 82 are moved in a direction perpendicular to the surface of the wafer W held by the wafer stage 23 by a chuck moving mechanism (not shown).

A hand 73 of the wafer transport mechanism transports the wafer W to a position between the first chuck hand 81 and the second chuck hand 82. When the first chuck hand 81 and the second chuck hand 82 are moved closer to each other, the cylindrical hooks 83 of the first chuck hand 81 and the second chuck hand 82 are brought into contact with the periphery of the wafer W, whereby the wafer W is clamped by the first chuck hand 81 and the second chuck hand 82. A center of the wafer W when held by the chuck hands 81 and 82 and a center of the wafer stage 23 (i.e., a rotational axis of the wafer stage 23) agree with each other. Therefore, the first chuck hand 81 and the second chuck hand 82 also function as a centering mechanism.

As shown in FIG. 3, the stage-moving mechanism 30 includes a cylindrical shaft base 29 configured to rotatably support the hollow shaft 27, a support plate 32 to which the shaft base 29 is secured, a movable plate 33 which is movable in unison with the support plate 32, a ball screw b2 coupled to the movable plate 33, and a motor m2 configured to rotate the ball screw b2. The movable plate 33 is coupled to a lower surface of the partition plate 14 via linear guides 35 that allow the movable plate 33 to move in a direction parallel to the upper surface of the wafer stage 23. The shaft base 29 extends through a through-hole 17 formed in the partition plate 14. The above-mentioned motor m1 for rotating the hollow shaft 27 is secured to the support plate 32.

In these configurations, when the ball screw b2 is rotated by the motor m2, the movable plate 33, the shaft base 29, and the hollow shaft 27 move in the longitudinal direction of the linear guides 35 to cause the wafer stage 23 to move in the direction parallel to the upper surface thereof. In FIG. 3, the moving direction of the wafer stage 23 by the stage-moving mechanism 30 is indicated by arrows X.

As shown in FIG. 3, the polishing unit 50 includes a polishing tape 41, a polishing head 42 configured to press the polishing tape 41 against the periphery of the wafer W, a supply reel 45*a* configured to supply the polishing tape 41 to the polishing head 42, and a recovery reel 45*b* configured to recover the polishing tape 41 that has been fed to the polishing head 42. The supply reel 45*a* and the recovery reel 45*b* are contained in a reel chamber 45 provided in the housing 11 of the polishing apparatus.

Figure 5A:
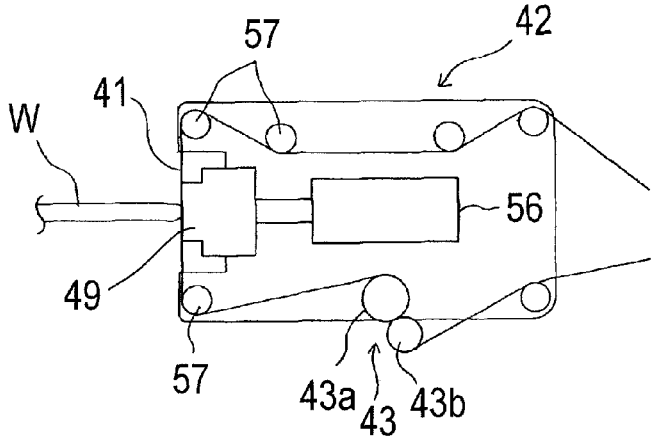
FIG. 5A is an enlarged view showing a polishing head.
Figure 5B:
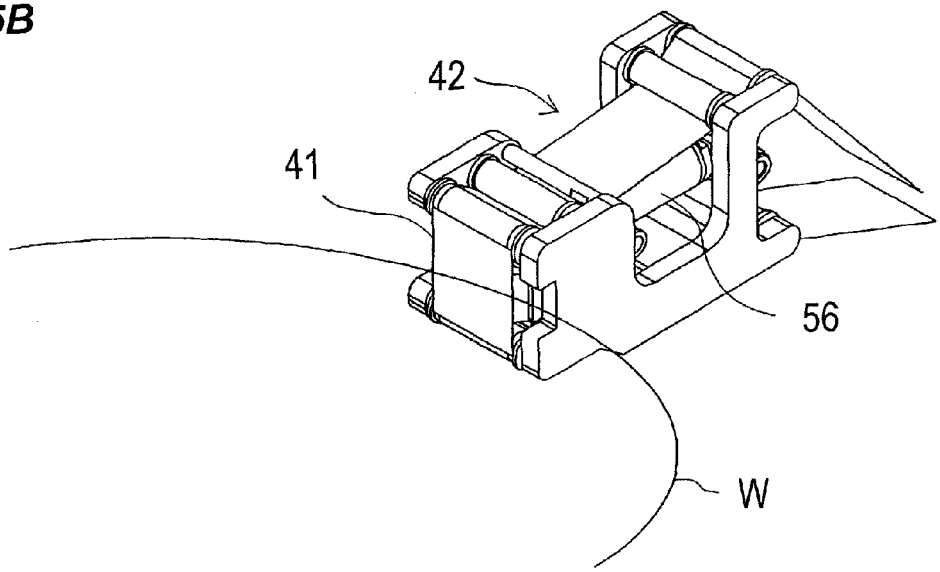
FIG. 5B is a perspective view showing the polishing head.

FIG. 5A is an enlarged view showing the polishing head 42 and FIG. 5B is a perspective view showing the polishing head 42. As shown in FIGS. 5A and 5B, the polishing head 42 has a tape-sending mechanism 43 therein. The polishing tape 41 is sandwiched between rollers 43*a* and 43*b*, while the roller 43*a* is rotated by a motor (not shown) to thereby send the polishing tape 41. The polishing head 42 further includes a press pad (back pad) 49 arranged at a rear side of the polishing tape 41, a press mechanism (e.g., an air cylinder) 56 coupled to the press pad 49, and a plurality of guide rollers 57 arranged so as to guide a travel direction of the polishing tape 41. The press mechanism 56 causes the press pad 49 to move toward the wafer W to thereby press a polishing surface of the polishing tape 41 against the periphery of the wafer W through the press pad 49.

As shown in FIG. 3, polishing-liquid supply nozzles 58 are arranged above and below the wafer W. During polishing, the wafer W is rotated by the stage-rotating mechanism 40, while pure water as a polishing liquid is supplied onto a center of an upper surface of the wafer W from the upper polishing-liquid supply nozzle 58 and pure water is supplied onto a contact portion between the wafer W and the polishing tape 41 from the lower polishing-liquid supply nozzle 58. The polishing tape 41 is pulled out from the supply reel 45*a* by the tape-sending mechanism 43, and is directed to the polishing head 42. The polishing head 42 brings the polishing surface of the polishing tape 41 into contact with the periphery of the wafer W. After contacting the periphery, the polishing tape 41 is wound on the recovery reel 45*b*.

Figure 6A:
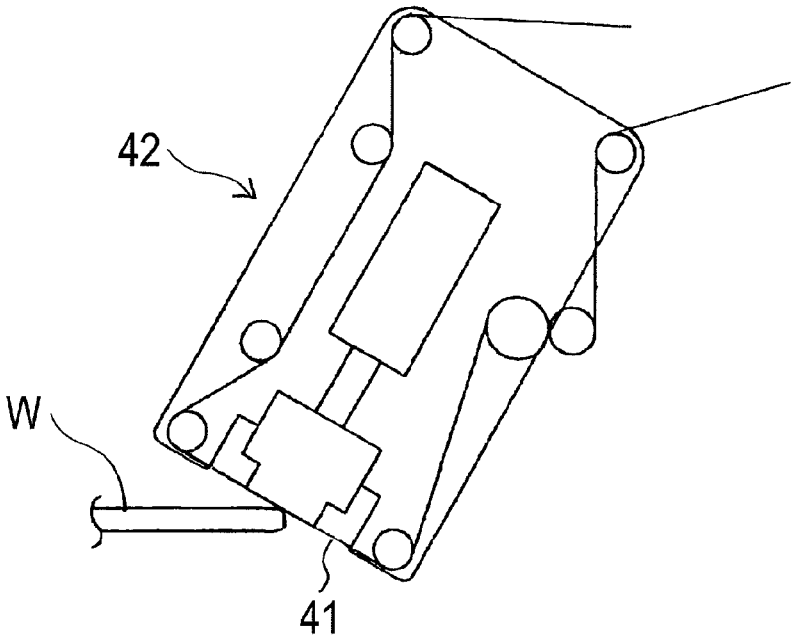
FIG. 6A and FIG. 6B are views each showing a state in which the polishing head is tilted.
Figure 6B:
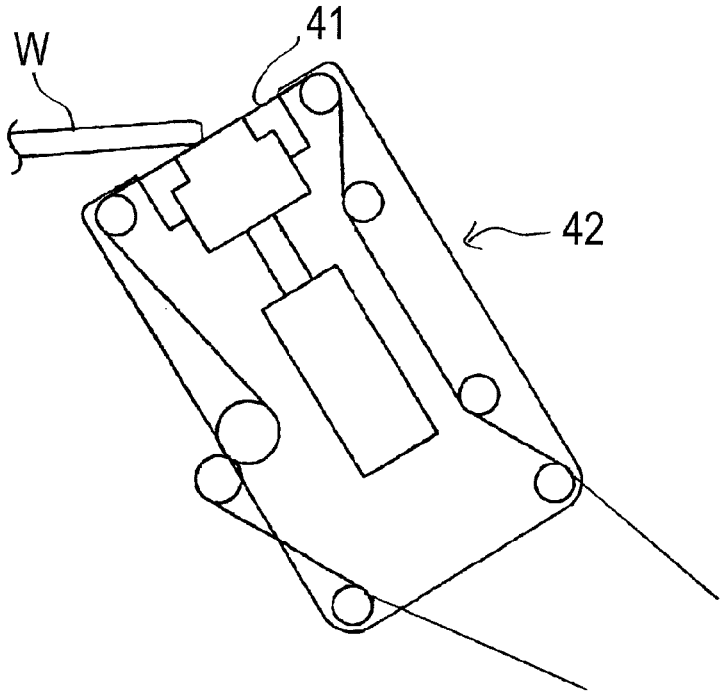

FIG. 6A and FIG. 6B are views each showing a state in which the polishing head 42 is tilted. As shown in FIGS. 6A and 6B, the polishing head 42 is configured to be tilted upwardly and downwardly by a tilting mechanism (not shown), with a center of the tilting motion of the polishing head 42 on the periphery of the wafer W. Thus, the periphery of the wafer W in its entirety, including the bevel portion and the edge-cut portion, is polished by the polishing tape 41. The tilting mechanism for tilting the polishing head 42 may comprise a known mechanism including a rotational shaft supporting the polishing head 42, and a motor, pulleys, and a belt for rotating the rotational shaft.

The polishing tape 41 can be constituted by a base film and abrasive particles, such as diamond particles or SiC particles, bonded to one side surface of the base film. This surface with the abrasive particles provides the polishing surface. The abrasive particles to be bonded to the polishing tape 41 are selected according to a type of wafer W and a required polishing capability. Examples of the abrasive particles to be used include diamond particles and SiC particles having an average diameter ranging from 0.1 μm to 5.0 μm. A belt-shaped polishing cloth with no abrasive particles can also be used. The base film may be a film made from a flexible material, such as polyester, polyurethane, or polyethylene terephthalate.

Figure 7A:
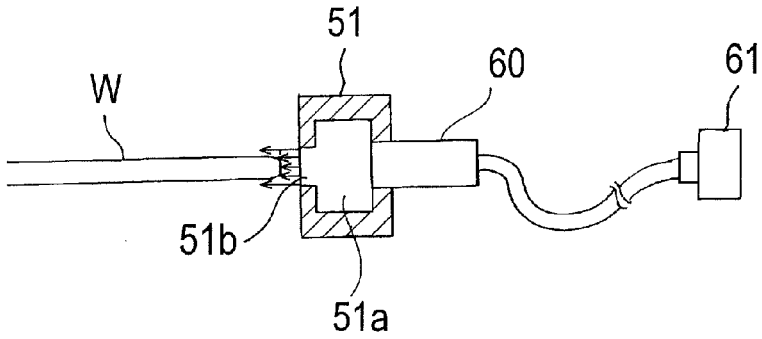
FIG. 7A is a partial cross-sectional view of a water ejector and a terminal imaging element shown in FIG. 2.
Figure 7B:
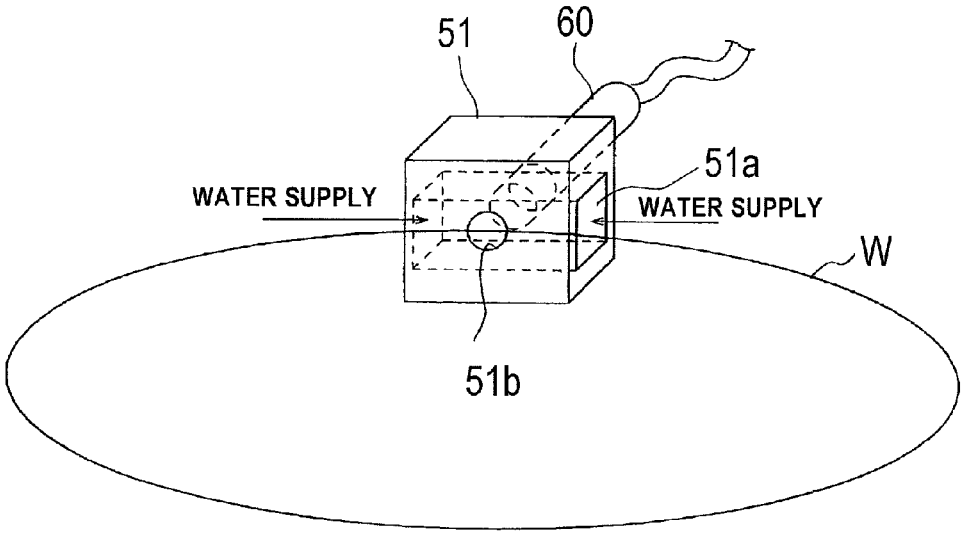
FIG. 7B is a perspective view of the water ejector and the terminal imaging element.

FIG. 7A is a partial cross-sectional view of the water ejector 51 and the terminal imaging element 60 shown in FIG. 2, and FIG. 7B is a perspective view of the water ejector 51 and the terminal imaging element 60. As shown in FIG. 7A and FIG. 7B, the water ejector 51 has a liquid passage 51*a* defined therein which has open ends on both side surfaces of the water ejector 51. The liquid passage 51*a* is supplied with water (preferably pure water) from a liquid supply source (not shown). The water ejector 51 also has an ejection hole 51*b* in communication with the liquid passage 51*a*. The ejection hole 51*b* extends perpendicularly to a tangential direction of the wafer W. The water flows through the liquid passage 51*a* and is ejected from the ejection hole 51*b* perpendicularly to the periphery of the wafer W. The water ejector 51 is located adjacent to the periphery of the wafer W.

The terminal imaging element 60 is secured to the water ejector 51. The terminal imaging element 60 is oriented in a direction perpendicular to the tangential direction of the wafer W. The above-described ejection hole 51*b* is located on an extension of the terminal imaging element 60. The terminal imaging element 60 has a tip end facing the liquid passage 51*a*. With such arrangements, no obstacle exists between the terminal imaging element 60 and the periphery of the wafer W, and the CCD camera 61 is capable of capturing an image of the periphery of the wafer W through the terminal imaging element 60. When the CCD camera 61 captures an image of the periphery of the wafer W, the water is supplied to the liquid passage 51*a* so that the ejection hole 51*b* ejects the water toward the periphery of the wafer W. By ejecting the water from the ejection hole 51*b*, the polishing liquid from the polishing liquid supply nozzles 58 and particles are not attached to the terminal imaging element 60. Hence, a clear image can be obtained.

When an image of the periphery of the wafer W is captured, a space between the terminal imaging element 60 and the periphery of the wafer W is filled with the water. In order to capture a clear image, it is necessary that no air bubbles exist in the water that is present between the terminal imaging element 60 and the periphery of the wafer W. To prevent the water from containing air bubbles, it is necessary that a flow velocity of the water from the ejection hole 51*b* be higher than a speed of the periphery of the rotating wafer W. This requirement is based on the need for supplying more water than an amount of water that is scattered away in the tangential direction by the rotating wafer W. For example, when the wafer W having a diameter of 200 mm is rotated at a speed of 1000 $min^{-1}$, the speed of the periphery of the wafer W is 10.5 m/s and the flow velocity of the water from the ejection hole 51*b* is 10.6 m/s. Thus, the flow velocity of the water from the ejection hole 51*b* is determined according to the speed of the periphery of the wafer W. In order not to produce air bubbles in the water, the ejection hole 51*b* should preferably be as close to the periphery of the wafer W as possible.

Figure 8A:
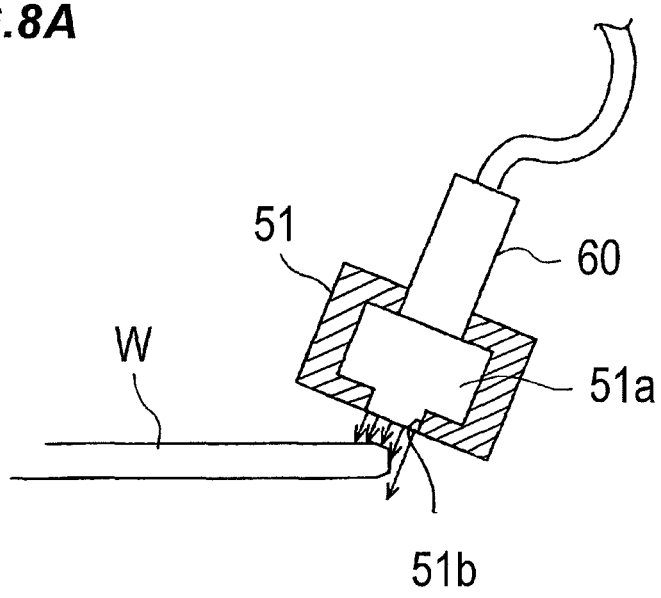
FIG. 8A and FIG. 8B are views each showing a state in which the water ejector and the terminal imaging element are tilted.
Figure 8B:
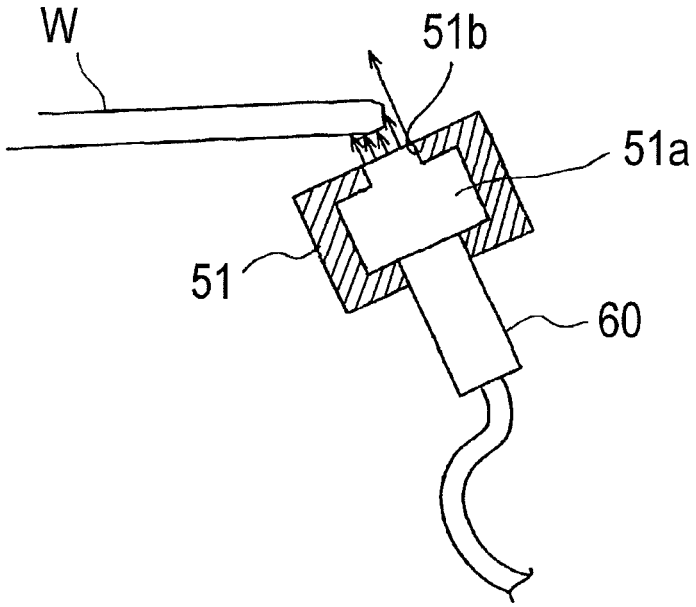

FIG. 8A and FIG. 8B are views each showing a state in which the water ejector 51 and the terminal imaging element 60 are tilted. As shown in FIG. 8A and FIG. 8B, the water ejector 51 and the terminal imaging element 60 are arranged such that they can be tilted by a tilting mechanism (not shown) in synchronism with the polishing head 42. This configuration enables the CCD camera 61 to capture an image of the periphery in its entirety, including the bevel portion and edge-cut portion of the wafer W, through the terminal imaging element 60, while the ejection hole 51*b* ejects the water toward the periphery of the wafer W. Since the water ejector 51 and the terminal imaging element 60 are tilted in unison with each other, the space between the terminal imaging element 60 and the periphery of the wafer W is filled with the water at all times regardless of a tilt angle of the water ejector 51 and the terminal imaging element 60. Therefore, the CCD camera 61 can capture a clear image of the entire periphery of the wafer W transmitted from the terminal imaging element 60. The tilting mechanism for tilting the water ejector 51 and the terminal imaging element 60 may comprise a known mechanism including a rotational shaft supporting the water ejector 51, and a motor, pulleys, and a belt for rotating the rotational shaft.

Figure 9A:
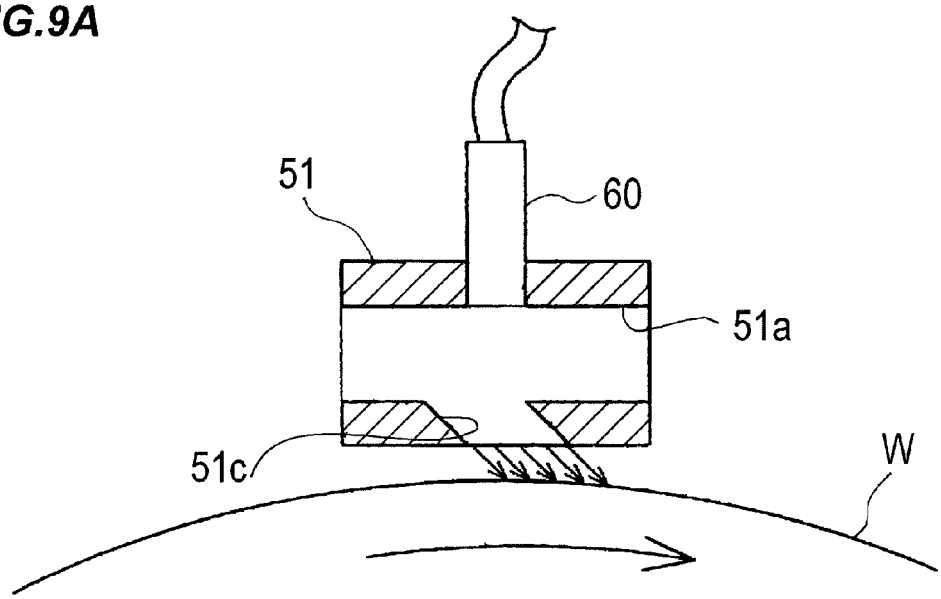
FIG. 9A is a cross-sectional view showing another example of the water ejector.
Figure 9B:
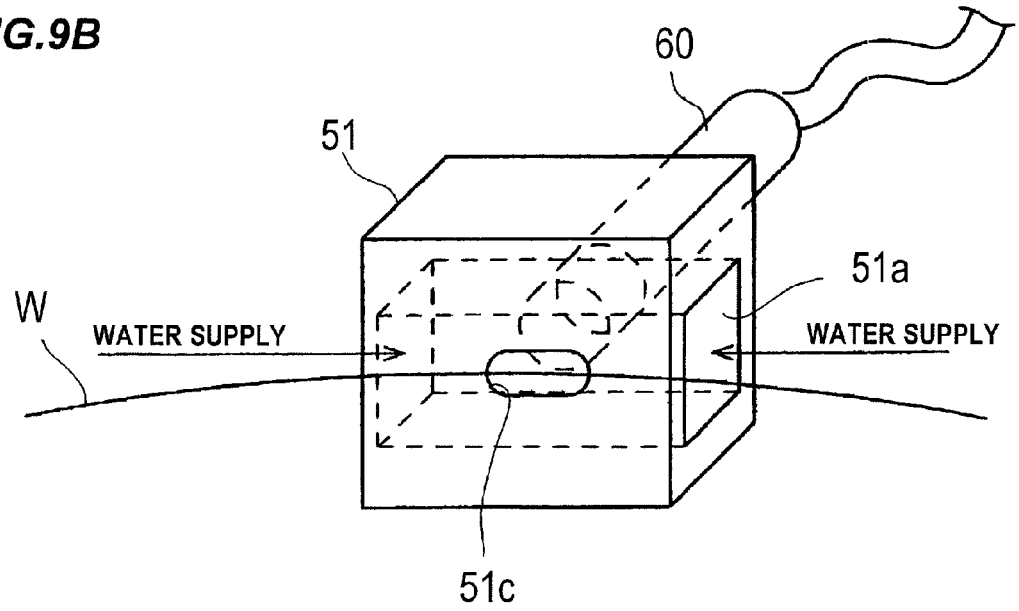
FIG. 9B is a perspective view of the water ejector shown in FIG. 9A.

FIG. 9A is a cross-sectional view showing another example of the water ejector, and FIG. 9B is a perspective view of the water ejector shown in FIG. 9A. In this example shown in FIG. 9A and FIG. 9B, an ejection hole 51*c* has a wide cross-sectional shape and is inclined at an angle of 45 degrees with respect to the tangential direction of the wafer W. A travel direction of the water ejected from the ejection hole 51*c* in this example is such that the water does not oppose the rotational direction of the wafer W, in order not to produce the air bubbles when the water impinges upon the wafer W. Other structures of the water ejector are identical to those of the example shown in FIGS. 7A and 7B.

Figure 10A:
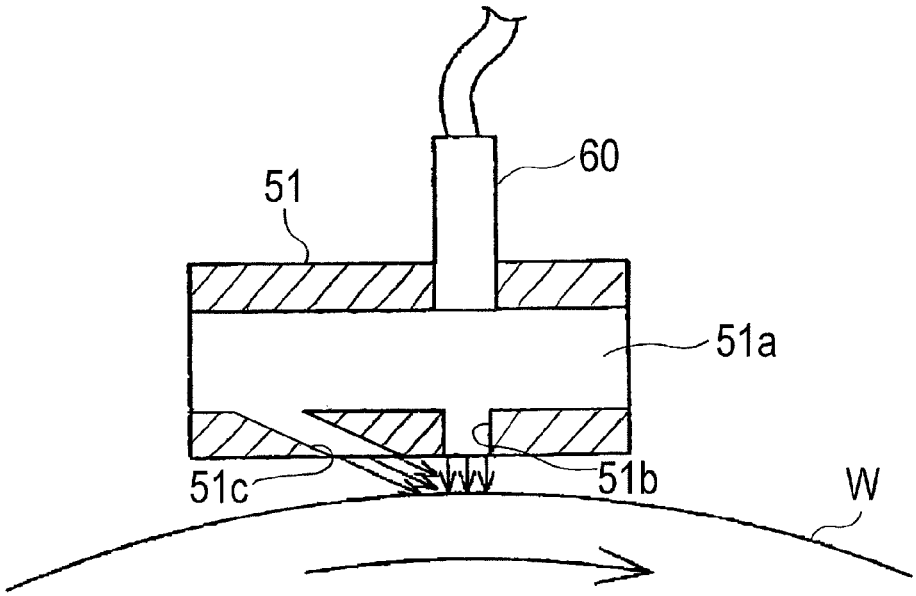
FIG. 10A is a cross-sectional view showing still another example of the water ejector.
Figure 10B:
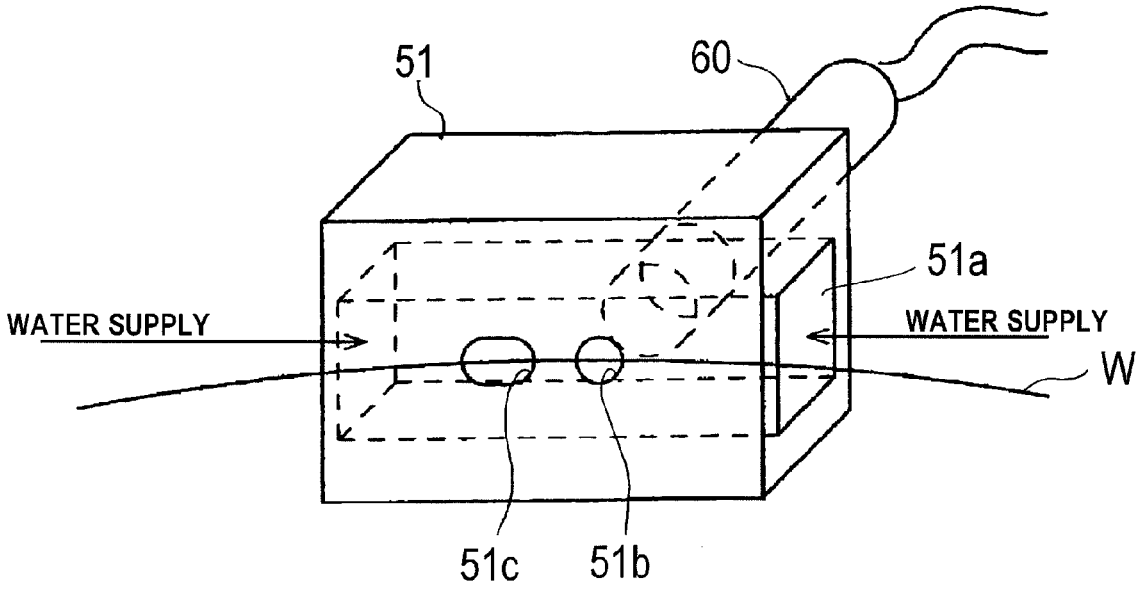
FIG. 10B is a perspective view of the water ejector shown in FIG. 10A.

FIG. 10A is a cross-sectional view showing still another example of the water ejector, and FIG. 10B is a perspective view of the water ejector shown in FIG. 10A. Water ejector 51 shown in FIG. 10A and FIG. 10B has a first ejection hole 51*b* and a second ejection hole 51*c* which are located adjacent to each other. The first ejection hole 51*b* extends perpendicularly to the tangential direction of the wafer W and is disposed on an extension of the terminal imaging element 60. On the other hand, the second ejection hole 51*c* is inclined at an angle of 25 degrees with respect to the tangential direction of the wafer W. In this example also, the water, ejected from the ejection hole 51*c*, travels in a direction that does not oppose the rotational direction of the wafer W, so that no air bubbles will be produced when the water impinges upon the wafer W.

In the examples shown in FIG. 9A through FIG. 10B, the water is ejected obliquely to the tangential direction of the wafer W. This is because the polishing liquid from the polishing liquid supply nozzles 58 and particles contained in the polishing liquid are not pushed back to the device region by the water from the ejection hole 51*c*. The angles of the water ejected from the ejection holes 51*b* and 51*c* with respect to the tangential direction of the wafer W are selected from a range of 0 degree to 90 degrees. The ejection of the water at an angle of 0 degree means that the water is ejected in a direction along the tangential direction of the wafer W. In the example shown in FIGS. 7A and 7B, the angle of the water is 90 degrees. The angle of the ejection hole (second ejection hole) 51*c* should preferably be selected from a range of 25 to 45 degrees.

Figure 11A:
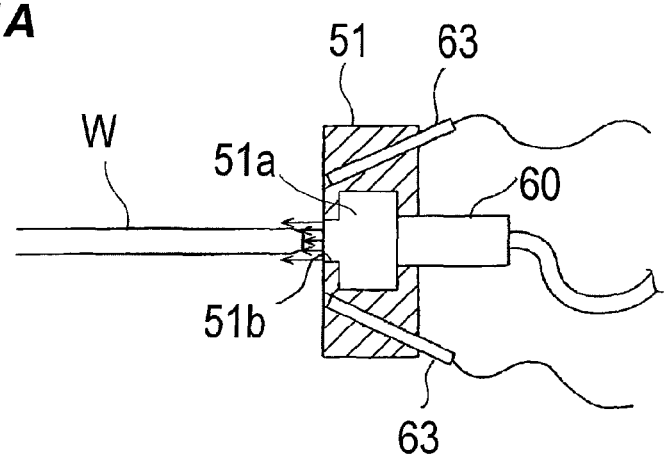
FIG. 11A is a partial cross-sectional view showing another example of the water ejector and the terminal imaging element.
Figure 11B:
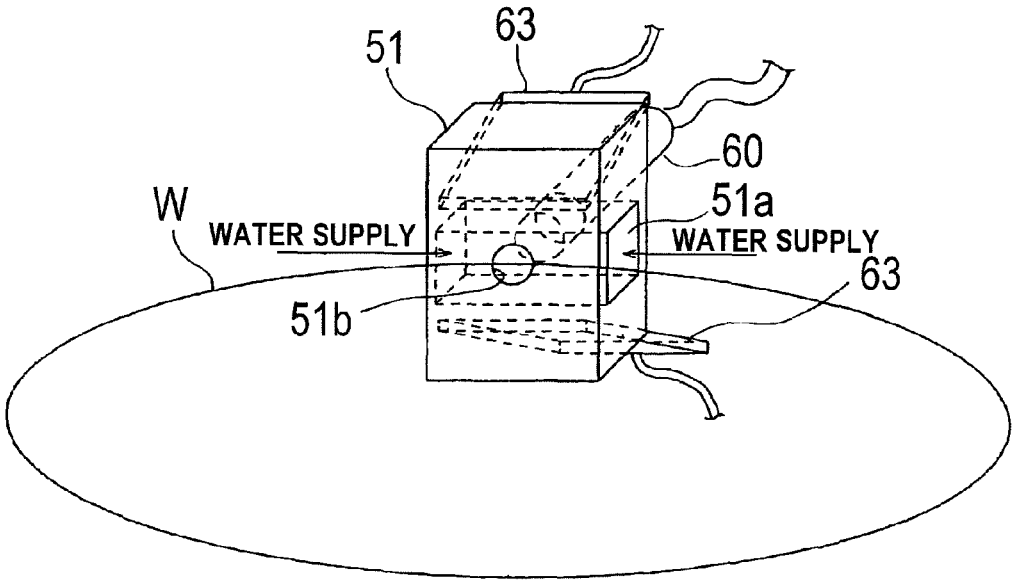
FIG. 11B is a perspective view of the water ejector and the terminal imaging element shown in FIG. 11A.

FIG. 11A is a partial cross-sectional view showing another example of the water ejector and the terminal imaging element, and FIG. 11B is a perspective view of the water ejector and the terminal imaging element shown in FIG. 11A. As shown in FIG. 11A and FIG. 11B, illuminators 63 are disposed above and below the terminal imaging element 60. The illuminators 63, which are embedded in the water ejector 51, illuminate the periphery of the wafer W. The multiple illuminators 63 (i.e., lighting from multiple directions) can provide uniform illumination with no variation in light intensity.

Figure 12A:
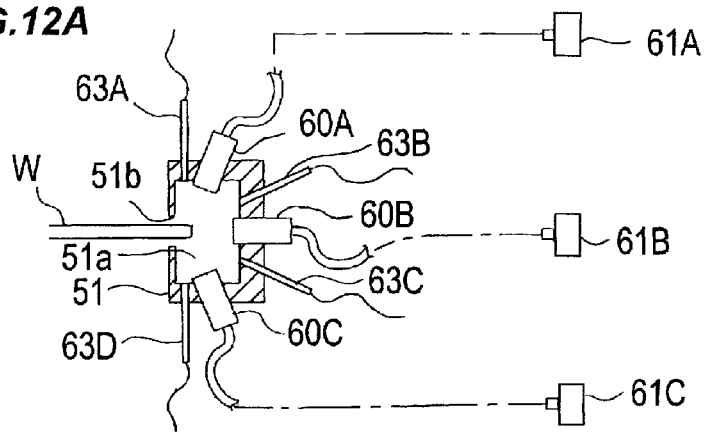
FIG. 12A is a partial cross-sectional view showing a water ejector and terminal imaging elements according to a second embodiment of the present invention.
Figure 12B:
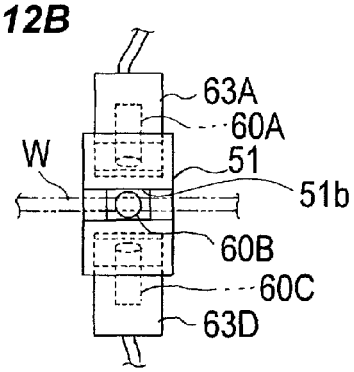
FIG. 12B is a front view of the water ejector and the terminal imaging elements shown in FIG. 12A.
Figure 12C:
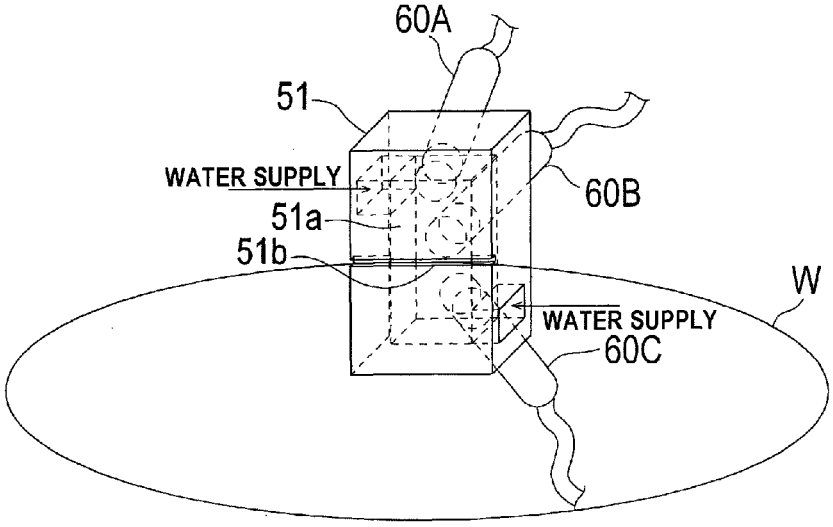
FIG. 12C is a perspective view of the water ejector and the terminal imaging elements shown in FIG. 12A.

FIG. 12A is a partial cross-sectional view showing a water ejector and terminal imaging elements according to a second embodiment of the present invention, FIG. 12B is a front view of the water ejector and the terminal imaging elements shown in FIG. 12A, and FIG. 12C is a perspective view of the water ejector and the terminal imaging elements shown in FIG. 12A. Other structural details of the present embodiment, which will not be described, are identical to those of the first embodiment, and repetitive description thereof will be omitted.

As shown in FIGS. 12A through 12C, in the present embodiment, three terminal imaging elements 60A, 60B, and 60C and four illuminators 63A, 63B, 63C, and 63D are provided. The first terminal imaging element 60A is disposed above the wafer W, the second terminal imaging element 60B is disposed parallel to the wafer W, and the third terminal imaging element 60C is disposed below the wafer W. The illuminators 63A and 63B are disposed on both sides of the first terminal imaging element 60A, the illuminators 63B and 63C are disposed on both sides of the second terminal imaging element 60B, and the illuminators 63C and 63D are disposed on both sides of the third terminal imaging element 60C. All of the terminal imaging elements 60A, 60B, and 60C and the illuminators 63A, 63B, 63C, and 63D are oriented toward the periphery of the wafer W. More specifically, the first terminal imaging element 60A is oriented toward an upper portion of the periphery, the second terminal imaging element 60B is oriented toward a central portion of the periphery, and the third terminal imaging element 60C is oriented toward a lower portion of the periphery.

In the present embodiment, the terminal imaging elements 60A through 60C are coupled respectively to CCD cameras 61A through 61C. The water ejector 51 and the terminal imaging elements 60A through 60C according to the present embodiment are fixed in position and are not tiltable with respect to the wafer W, unlike the first embodiment. The ejection hole 51*b*, which has a wide shape, ejects water in a direction perpendicular to the tangential direction of the wafer W. The ejection hole 51*b* shown in FIGS. 12A and 12B is illustrated such that a vertical width thereof is greater than a vertical width of the ejection hole 51*b* shown in FIG. 12C for the purpose of explaining structural details. The terminal imaging elements 60A through 60C have respective tip ends located in the liquid passage 51*a*, and spaces between the periphery of the wafer W and the terminal imaging elements 60A through 60C are filled with water flowing through the liquid passage 51*a*. With these arrangements, images of the upper portion, the central portion, and the lower portion of the periphery of the wafer W can be captured through the terminal imaging elements 60A through 60C without tilting the water ejector 51 and the terminal imaging elements 60A through 60C.

Figure 13:
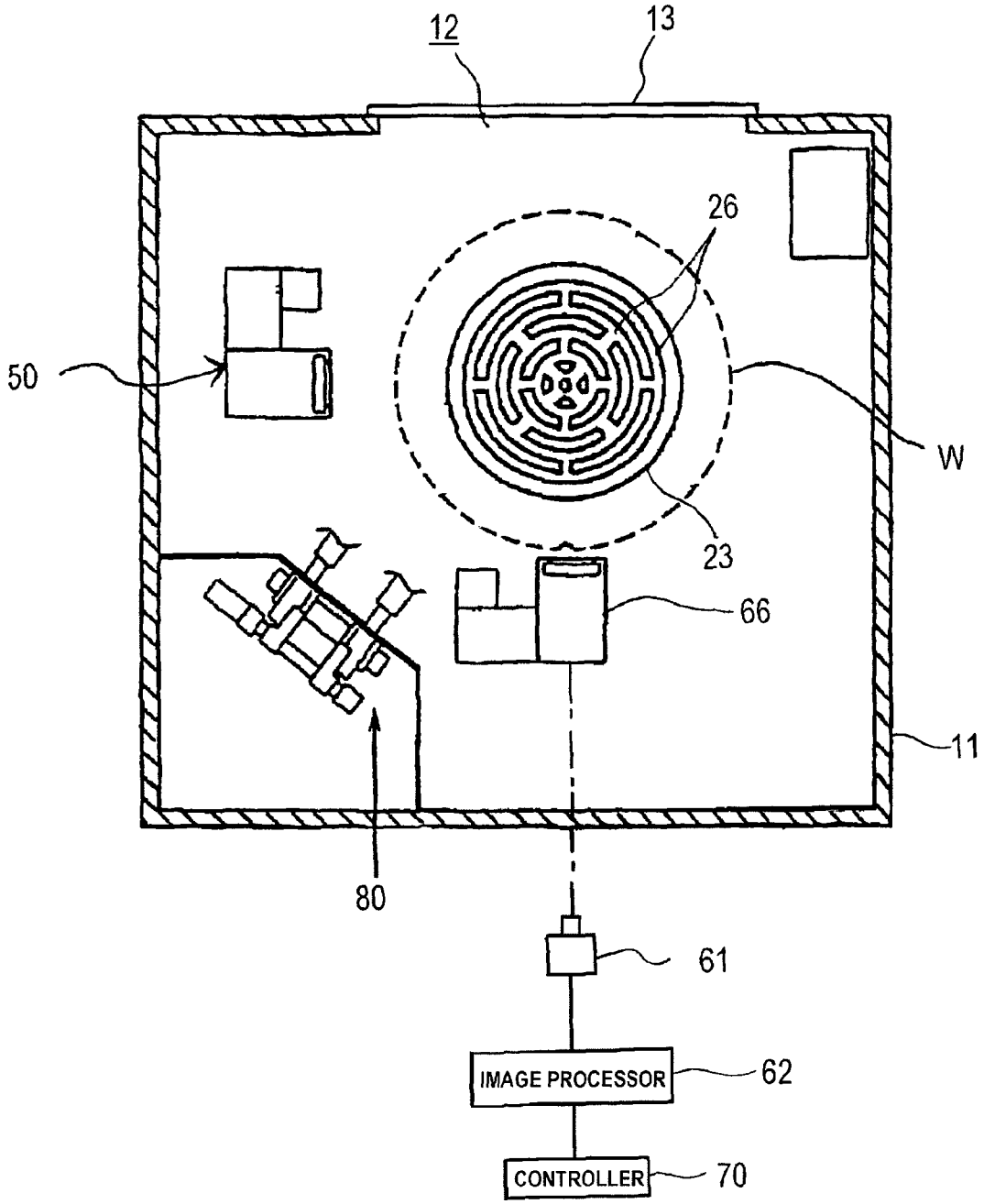
FIG. 13 is a plan view showing a polishing apparatus according to a third embodiment of the present invention.

FIG. 13 is a plan view showing a polishing apparatus according to a third embodiment of the present invention. Other structural details of the present embodiment, which will not be described, are identical to those of the first embodiment, and repetitive description thereof will be omitted.

Figure 14A:
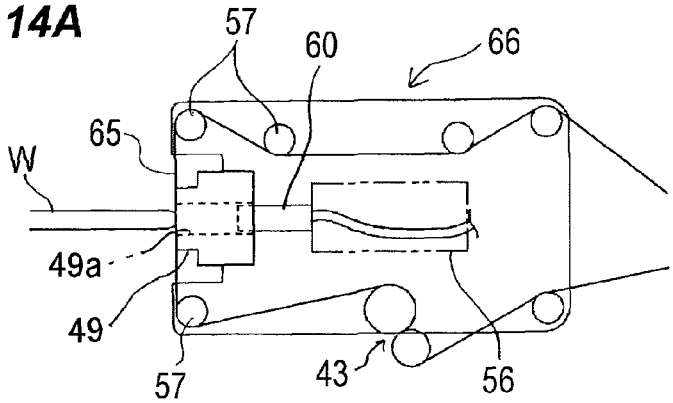
FIG. 14A is a side view of a contact head shown in FIG. 13.
Figure 14B:
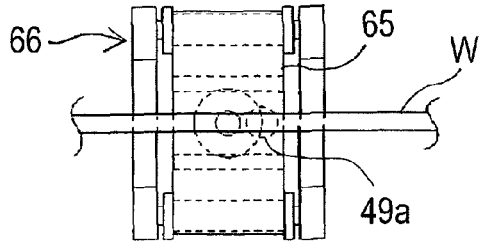
FIG. 14B is a front view of the contact head shown in FIG. 14A.
Figure 14C:
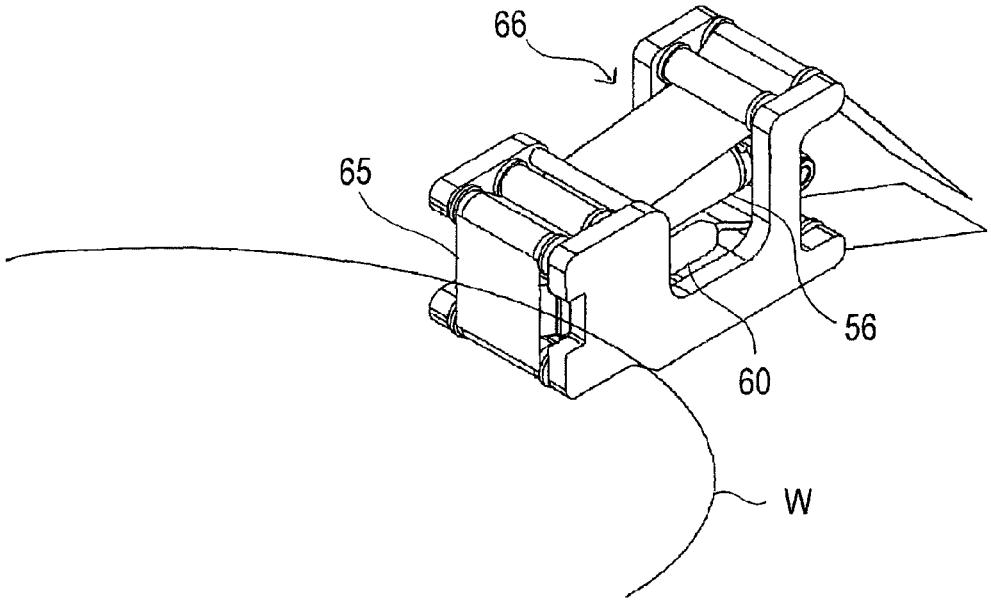
FIG. 14C is a perspective view of the contact head shown in FIG. 14A.

As shown in FIG. 13, a contact head 66, which is configured to bring a transparent tape into contact with the periphery of the wafer W, is provided in the present embodiment, instead of the water ejector 51. FIG. 14A is a side view of the contact head shown in FIG. 13, FIG. 14B is a front view of the contact head shown in FIG. 14A, and FIG. 14C is a perspective view of the contact head shown in FIG. 14A. As shown in FIGS. 14A through 14C, the contact head 66 is basically identical in structure to the polishing head 42.

Instead of the polishing tape 41, a light-transmissive transparent tape 65 is used in the contact head 66. The transparent tape 65 is supplied from a supply reel (not shown) to the contact head 66, sent in a longitudinal direction thereof by a tape-sending mechanism 43, and recovered by a recovery reel (not shown). As with the polishing head 42, the contact head 66 has a press pad 49 and a press mechanism 56. The press mechanism 56 is configured to cause the press pad 49 to press the transparent tape 65 against the periphery of the wafer W.

The press pad 49 has a through-hole 49*a* extending perpendicularly to the tangential direction of the wafer W. Part of the terminal imaging element 60 is inserted in the through-hole 49*a*, and the terminal imaging element 60 is oriented toward the periphery of the wafer W. The through-hole 49*a* is located at the rear side of the transparent tape 65, so that the terminal imaging element 60 can send an image of the periphery of the wafer W through the transparent tape 65 to the CCD camera 61. The contact head 66 has an illuminator (not shown) for illuminating the periphery of the wafer W from behind the transparent tape 65. As with the polishing head 42, the contact head 66 is tiltable with respect to the wafer W for allowing the CCD camera 61 to capture an image of the entire periphery of the wafer W including the upper portion, the central portion, and the lower portion thereof.

When capturing an image of the periphery of the wafer W, the transparent tape 65 is pressed against the periphery of the wafer W by the press pad 49. The transparent tape 65 prevents the polishing liquid from the polishing liquid supply nozzles 58 and particles from adhering to the terminal imaging element 60 and removes the polishing liquid and particles that have been attached to the periphery of the wafer W. Therefore, the CCD camera 61 can capture a clear image of the periphery of the wafer W through the terminal imaging element 60.

Figure 15A:
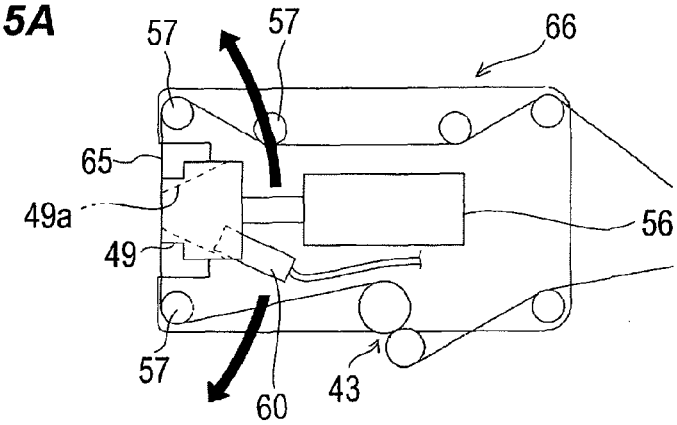
FIG. 15A is a side view of a contact head used in a polishing apparatus according to a fourth embodiment of the present invention.
Figure 15B:
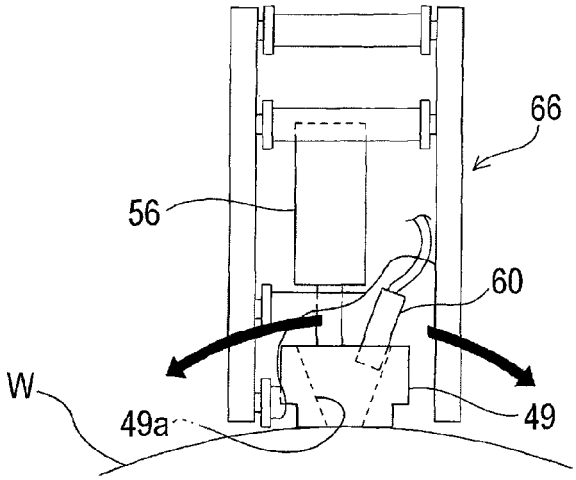
FIG. 15B is a plan view of the contact head shown in FIG. 15A.
Figure 15C:
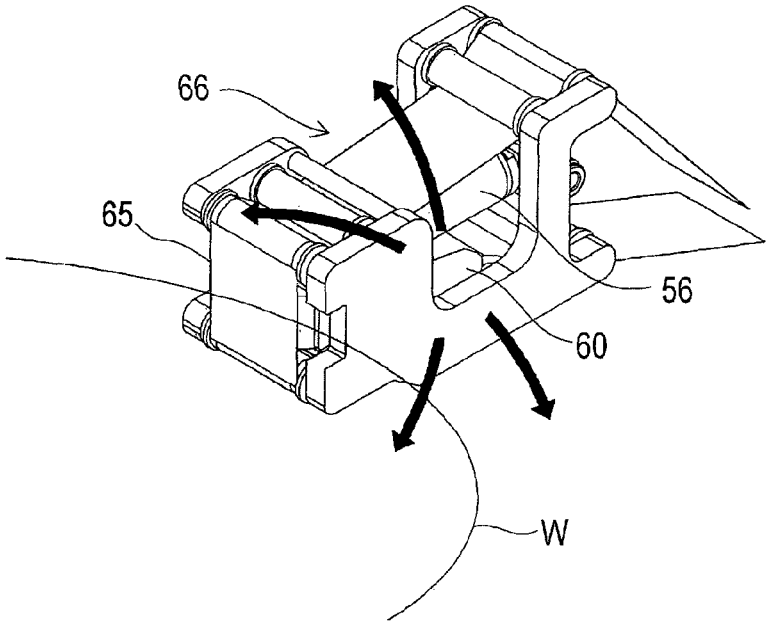
FIG. 15C is a perspective view of the contact head shown in FIG. 15A.

FIGS. 15A through 15C are views showing a contact head used in a polishing apparatus according to a fourth embodiment of the present invention. Other structural details of the present embodiment, which will not be described, are identical to those of the third embodiment, and repetitive description thereof will be omitted.

The transparent tape 65 may be shiny and glossy depending on the material thereof. When an image of the periphery of the wafer W is captured, the illuminator illuminates the periphery of the wafer W. If the terminal imaging element 60 is arranged at an angle of reflection corresponding to an angle of incident of light from the illuminator, the reflected light from the transparent tape 65 is applied to the CCD camera 61 through the terminal imaging element 60, causing noise on the image captured. To avoid such a drawback, the terminal imaging element 60 is configured to be freely tiltable with respect to a direction perpendicular to a polishing surface (and a rear surface) of the polishing tape 65, as shown in FIGS. 15A through 15C. The through-hole 49*a* has a size large enough to allow the terminal imaging element 60 to be tiltable therein. With this configuration, the terminal imaging element 60 can be arranged in a position away from the reflected light from the transparent tape 65, whereby the reflected light can be prevented from entering the terminal imaging element 60.

Figure 16A:
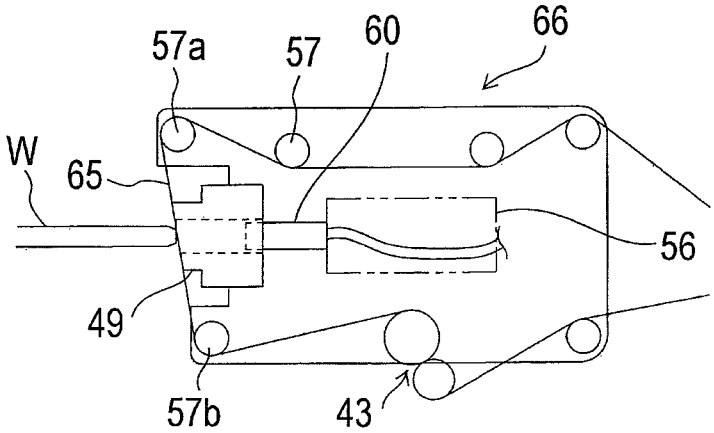
FIG. 16A is a side view of a contact head used in a polishing apparatus according to a fifth embodiment of the present invention.
Figure 16B:
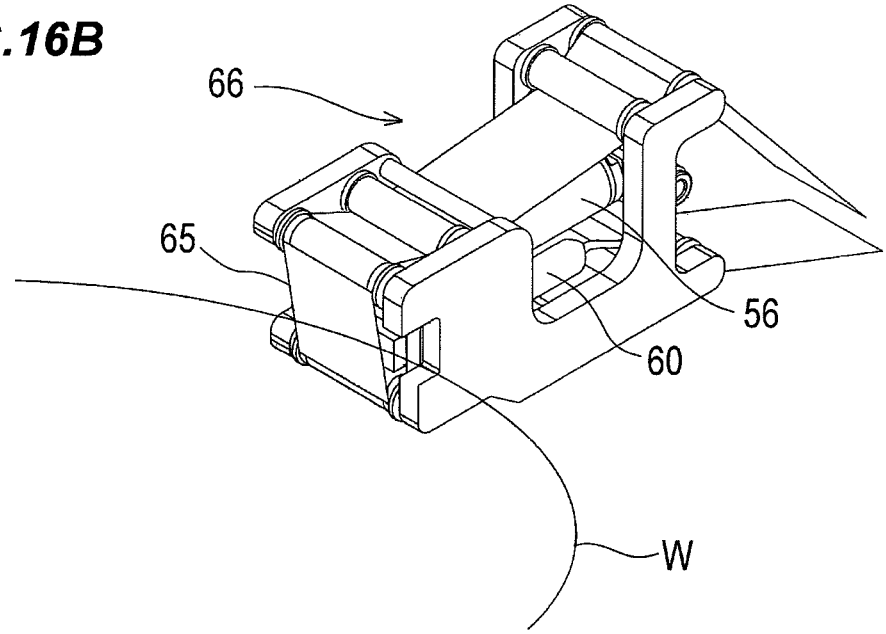
FIG. 16B is a perspective view of the contact head shown in FIG. 16A.

FIG. 16A and FIG. 16B are views showing a contact head used in a polishing apparatus according to a fifth embodiment of the present invention. Other structural details of the present embodiment, which will not be described, are identical to those of the third embodiment, and repetitive description thereof will be omitted. As shown in FIGS. 16A and 16B, two guide rollers 57*a* and 57*b*, which are located in tip end of contact head 66, are staggered in directions toward and away from the wafer W so that the transparent tape 65 travels obliquely between the guide rollers 57*a* and 57*b*. Therefore, the terminal imaging element 60 is oriented in a direction out of alignment with the direction perpendicular to the polishing surface (and the rear surface) of the transparent tape 65. With this arrangement, the reflected light from the transparent tape 65 is prevented from entering the terminal imaging element 60.

Figure 17A:
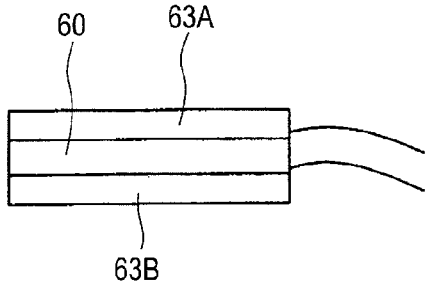
FIG. 17A is a side view showing examples of the terminal imaging element and an illuminator used in the above-described fourth and fifth embodiments.
Figure 17B:
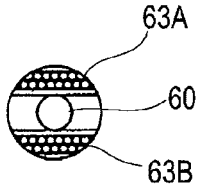
FIG. 17B is a front view of the terminal imaging element and the illuminator shown in FIG. 17A.
Figure 18A:
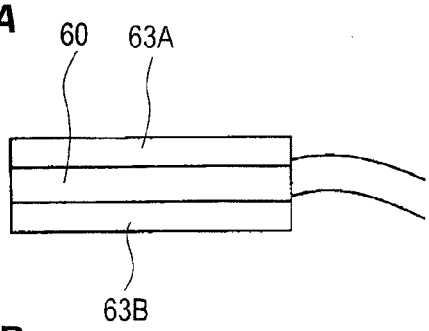
FIG. 18A is a side view showing another examples of the terminal imaging element and the illuminator used in the above-described fourth and fifth embodiments.
Figure 18B:
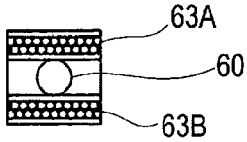
FIG. 18B is a front view of the terminal imaging element and the illuminator shown in FIG. 18A.

FIG. 17A is a side view showing examples of the terminal imaging element and the illuminator used in the above-described fourth and fifth embodiments, and FIG. 17B is a front view of the terminal imaging element and the illuminator shown in FIG. 17A. FIG. 18A is a side view showing another examples of the terminal imaging element and the illuminator used in the above-described fourth and fifth embodiments, and FIG. 18B is a front view of the terminal imaging element and the illuminator shown in FIG. 18A.

As shown in FIGS. 17A through 18B, illuminators 63A and 63B are mounted respectively on an upper portion and a lower portion of the terminal imaging element 60. The terminal imaging element 60 and the illuminators 63A and 63B are oriented in the same direction and are integrally assembled with each other. In the example shown in FIGS. 17A and 17B, the terminal imaging element 60 and the illuminators 63A and 63B constitute a unit having a circular cross-sectional shape. In the example shown in FIGS. 18A and 18B, the terminal imaging element 60 and the illuminators 63A and 63B constitute a unit having a rectangular cross-sectional shape. According to these examples, as long as the terminal imaging element 60 and the illuminators 63A and 63B are tilted with respect to the direction perpendicular to the polishing surface (and the rear surface) of the transparent tape 65, the reflected light from the transparent tape 65 does not enter the terminal imaging element 60.

As described above, the periphery of the wafer W is observed through the transparent tape 65 while the press mechanism 56 presses the transparent tape 65 against the periphery of the wafer W through the press pad 49. In a plan view of the polishing apparatus, the wafer W has a disk shape and on the other hand the press pad 49 has a rectangular shape. Consequently, the press pad 49 includes a portion where contact pressure on the wafer W is high and a portion where contact pressure on the wafer W is low. In other words, a pressure distribution is present in a circumferential direction of the wafer W. In the portion with the low contact pressure, the liquid and particles may enter a contact region between the periphery of the wafer W and the transparent tape 65. Therefore, the terminal imaging element 60 is arranged in such a position as to observe a portion where the highest contact pressure is applied. For example, the terminal imaging element 60 is arranged at the central portion of the press pad 49.

If a width of the portion under the highest contact pressure is known, the transparent tape 65 may have a width equal to that width, thereby reducing a cost of the transparent tape 65 which is an expendable item. To make the transparent tape 65 compatible with the polishing tape 41, the transparent tape 65 and the polishing tape 41 may have the same width. The transparent tape 65 may be provided with various functions in a portion other than the portion to which the highest contact pressure is applied. Specifically, the transparent tape 65 may be provided with a cleaning function or a polishing function.

For example, a portion of the transparent tape 65 may be made of a cloth for wiping the periphery of the wafer W. Furthermore, a portion of the transparent tape 65 may have a polishing surface. In the case where the transparent tape 65 is provided with the cleaning function, a sufficient clean observational environment is obtained without the need for applying the high contact pressure. Therefore, the load on the wafer W due to the contact pressure can be reduced.

Figure 19:
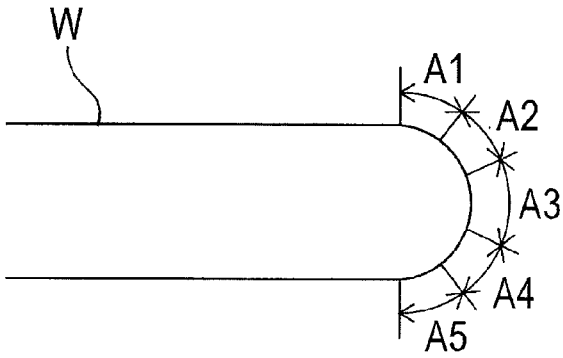
FIG. 19 is a schematic view showing five areas defined on the periphery of the wafer.

A process of polishing the bevel portion of the wafer W using the polishing apparatus according to the first through fifth embodiments will be described below. In an example described below, the periphery of the wafer W is divided into five areas A1, A2, A3, A4, and A5, and five-stage polishing is performed, as shown in FIG. 19. Specifically, the polishing head 42 is tilted as shown in FIGS. 6A and 6B so as to polish the areas A1 through A5 successively. Polishing of the areas A1 through A5 is monitored by the image processor 62, which detects polishing end points of the respective areas A1 through A5 based on images of the areas A1 through A5. Polishing of the periphery of the wafer W and image processing in the case of using the second embodiment shown in FIGS. 12A through 12C will be described below.

Figure 20A:
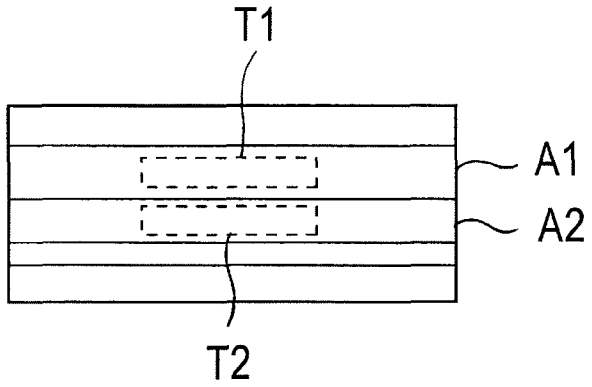
FIG. 20A is a schematic view showing an image of the periphery of the wafer that is captured through a first terminal imaging element shown in FIG. 12A.
Figure 20B:
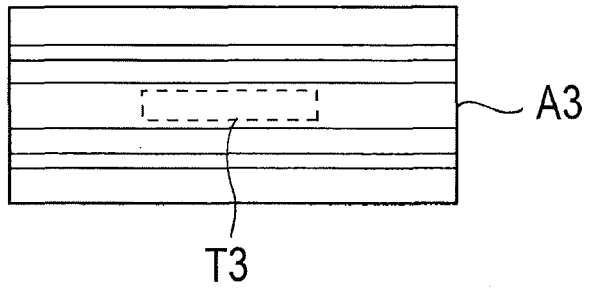
FIG. 20B is a schematic view showing an image of the periphery of the wafer that is captured through a second terminal imaging element shown in FIG. 12A.
Figure 20C:
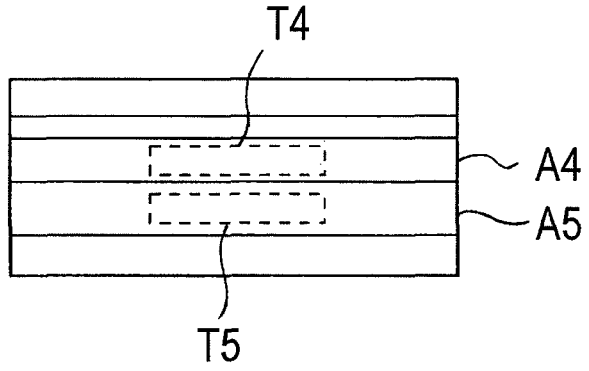
FIG. 20C is a schematic view showing an image of the periphery of the wafer that is captured through a third terminal imaging element shown in FIG. 12A.

In the second embodiment, the three CCD cameras 61A, 61B, and 61C are used to monitor polished states of the five areas A1, A2, A3, A4, and A5. FIG. 20A is a schematic view showing an image of the periphery of the wafer that is captured through the first terminal imaging element 60A shown in FIG. 12A. FIG. 20B is a schematic view showing an image of the periphery of the wafer that is captured through the second terminal imaging element 60B shown in FIG. 12A. FIG. 20C is a schematic view showing an image of the periphery of the wafer that is captured through the third terminal imaging element 60C shown in FIG. 12A.

As shown in FIGS. 20A through 20C, the image of the areas A1 and A2 is captured by the first CCD camera 61A through the first terminal imaging element 60A, the image of the area A3 is captured by the second CCD camera 61B through the second terminal imaging element 60B, and the image of the areas A4 and A5 is captured by the third CCD camera 61C through the third terminal imaging element 60C. Specific regions (which will be hereinafter referred to as target regions T1, T2, T3, T4, T5) to be monitored by the image processor 62 are established in advance in the areas A1 through A5, respectively. The image processor 62 monitors color of the target regions T1 through T5 and detects the polishing end points based on a change in the color. Regions that provide the best representation of the polished states of the areas A1 through A5 are selected as the target regions T1 through T5. Plural target regions may be set in one area.

Figure 21:
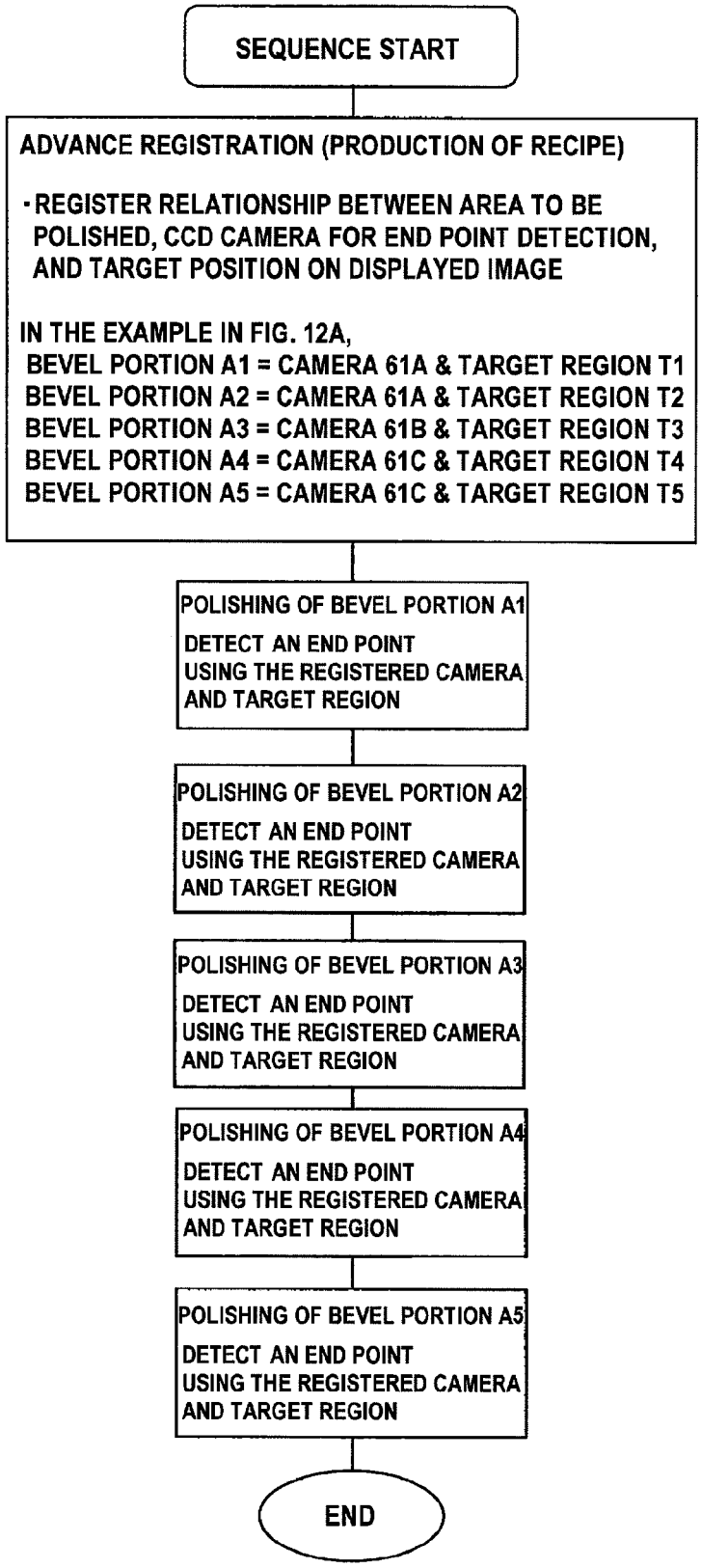
FIG. 21 is a polishing sequence of the polishing apparatus according to the second embodiment of the present invention.

A polishing sequence of the polishing apparatus according to the second embodiment will be described below with reference to FIG. 21. First, a relationship between the area to be polished, the CCD camera for capturing an image of the area to be polished, and the target region established in the area to be polished is registered in advance in the image processor 62. For example, when the area A1 is to be polished, an image captured by the first CCD camera 61A is used and an image of the target region T1 specified in the image is used for detecting a polishing end point. These conditions are set in the image processor 62.

Then, the polishing head 42 is tilted and polishes the area A1, and the polished state (i.e., the change in color) in the target region T1 is monitored. When a polishing end point of the area A1 is detected based on the change in color, the image processor 62 outputs a command for terminating polishing of the area A1 to the controller 70 (see FIG. 2), and further outputs a command for starting polishing of the area A2 to the controller 70. In this manner, the areas A1 through A5 are polished successively. While the bevel portion is polished in this example, the edge-cut portion (see FIG. 1) can also be polished as well.

A procedure of processing the image and detecting a polishing end point by the image processor 62 will be described below.

As described above, the image processor 62 detects a polishing end point based on the change in color of the target region. A target color is registered in advance in the image processor 62. The image processor 62 judges that a polishing end point is reached when the color of the target region is changed into the target color as a result of polishing. More specifically, the image processor 62 judges that a polishing end point is reached when the number of pixels having the target color of the target region has increased beyond a predetermined threshold value or when the number of pixels having the target color of the target region has decreased below a predetermined threshold value.

Shutter speeds (i.e., exposure times) and sampling intervals (image capturing intervals) of the respective CCD cameras 61A through 61C are set in advance in the respective CCD cameras 61A through 61C. Color correction using the illuminators 63 is performed in advance in order to cause the accurate target color to appear in the image. The shutter speeds (exposure times) of the respective CCD cameras 61A through 61C should preferably be longer than a time required for the wafer W to make one revolution. This is because of the need for monitoring the periphery of the wafer W in its entirety.

Figure 22:
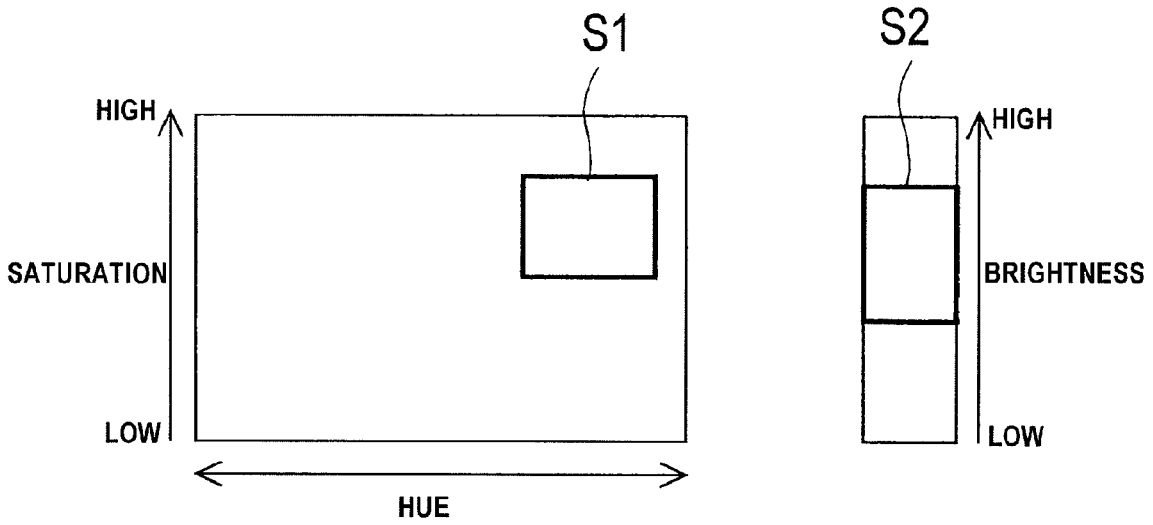
FIG. 22 shows a color chart and a brightness chart used for establishing a target color.

The target color may be selected from either a color which is to appear as a result of polishing (e.g., the color of silicon) or a color of an object to be polished (e.g., the color of $SiO_2$ or SiN). The color to be selected is not limited to one color, and multiple colors may be selected. FIG. 22 shows a color chart and a brightness chart used for establishing the target color. As shown in FIG. 22, the color chart has a horizontal axis indicating a distribution of hue and a vertical axis indicating saturation, and the brightness chart has a vertical axis indicating brightness level. The target color can be determined by color information (hue, saturation, and brightness) specified by scopes S1 and S2 that are placed in the color chart and the brightness chart.

Figure 23:
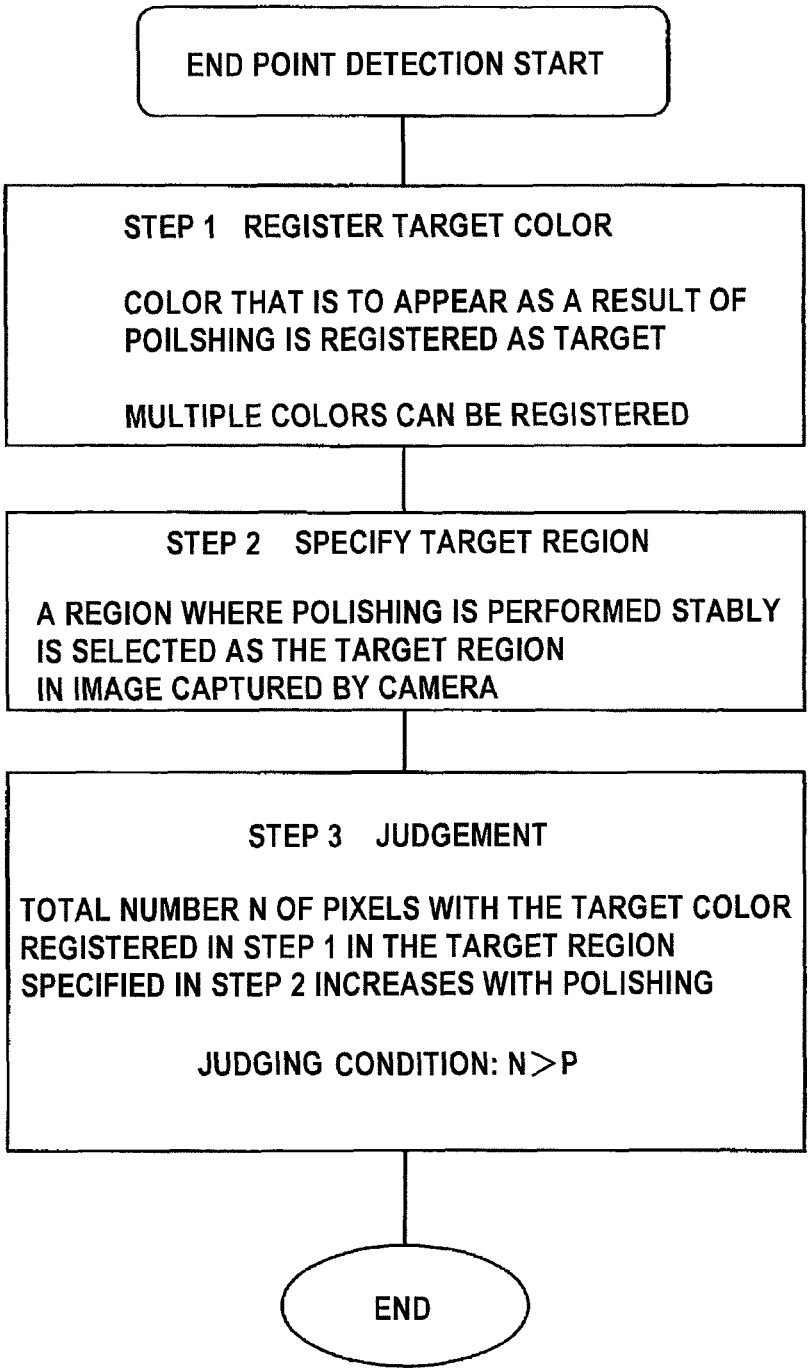
FIG. 23 is a diagram showing a polishing end point detecting process wherein a color of silicon is selected as the target color.

A polishing end point detecting process wherein the color of silicon is selected as the target color will be described below with reference to FIG. 23.

First, the color of silicon (typically, white) is registered as the target color in the image processor 62 (step 1). As described above, the color to be selected is not limited to one color, and multiple colors may be selected. Next, the target region is specified (step 2). When the number N of pixels having the target color in the target region exceeds a predetermined threshold value P, the image processor 62 judges that the polishing process is to be terminated (step 3). For increasing the accuracy of the polishing end point detection, the image processor 62 may judge that the polishing end point is reached when a period of time in which the number N of pixels is greater than the predetermined threshold value P exceeds a predetermined period of time.

Figure 24:
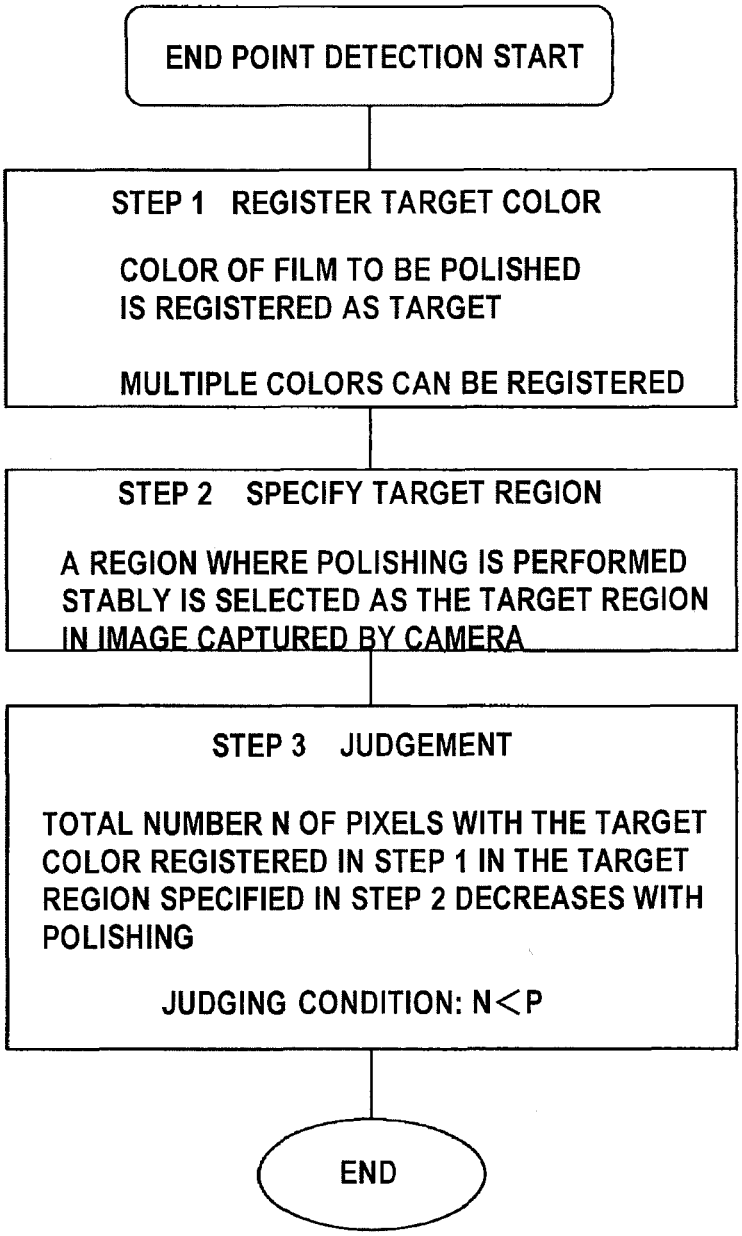
FIG. 24 is a diagram showing a polishing end point detecting process wherein a color of a film to be polished is selected as the target color.

FIG. 24 is a diagram showing a polishing end point detecting process wherein the color of a film to be polished is selected as the target color.

First, as shown in FIG. 24, the color of the film to be polished is registered as the target color in the image processor 62 (step 1). In this example also, the color to be selected is not limited to one color, and multiple colors may be selected. Next, the target region is specified (step 2). When the number N of pixels having the target color in the target region falls below a predetermined threshold value P, the image processor 62 judges that the polishing process is to be terminated (step 3). In this case also, for increasing the accuracy of the polishing end point detection, the image processor 62 may judge that the polishing end point is reached when a period of time in which the number N of pixels is smaller than the predetermined threshold value P exceeds a predetermined period of time.

In the above-described process, three terminal imaging elements are used to detect the polishing end point. In the first embodiment and the third through fifth embodiments also, the same image processing and polishing end point detection can be performed by tilting the terminal imaging element so as to capture images of the entire periphery of the wafer W.

In the above examples, the polishing end point is detected based on the change in color of the captured image. It is also possible to detect a surface roughness of the periphery from the captured image. A process of detecting the surface roughness of the periphery will be described below with reference to the second embodiment. In the first embodiment and the third through fifth embodiments also, the roughness of the polished surface can be detected in the same manner.

In this process of detecting the surface roughness, the shutter speeds (i.e., exposure times) of the respective CCD cameras 61A through 61C are set to be very short. Although specific shutter speeds are determined depending on the rotational speed of the wafer W, the shutter speeds need to be short enough to cause the shape (i.e., the surface roughness) of the surface of the periphery of the wafer W to appear in the image.

Images captured by the CCD cameras 61A through 61C are transmitted to the image processor 62, which processes the captured images. Specifically, the image processor 62 clips out the target regions (T1 through T5) from the captured images, and converts the clipped color images into black-and-white images. Subsequently, to emphasize the surface roughness, the image processor 62 applies a differential filter to the images to perform differential processing on the images. Thereafter, the obtained images are displayed on a histogram having a horizontal axis indicating brightness and a vertical axis indicating the number of pixels.

Figure 25A:
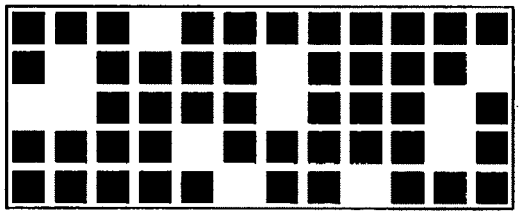
FIG. 25A is a schematic view showing an image when the periphery of the wafer has a rough surface.
Figure 25B:
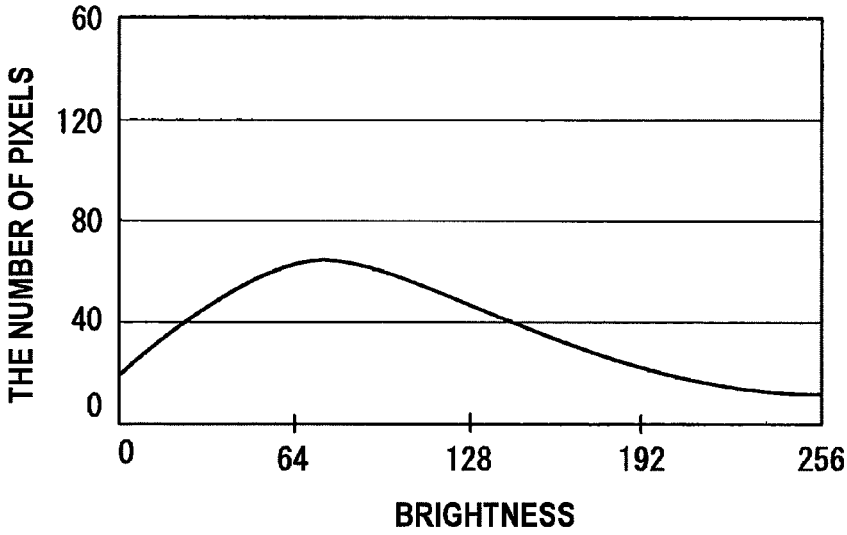
FIG. 25B is a histogram numerically expressing the image shown in FIG. 25A.

FIG. 25A is a schematic view showing an image when the periphery of the wafer has a rough surface, and FIG. 25B is a histogram numerically expressing the image shown in FIG. 25A. As shown in FIG. 25A, when the polished surface of the wafer W is rough, white spots indicative of surface irregularities appear in the image. This surface roughness can be expressed as a numerical value on the histogram. Specifically, when the polished surface is rough, many white spots appear in the image. As a result, the increased number of pixels with high brightness appears on the histogram.

Figure 26A:
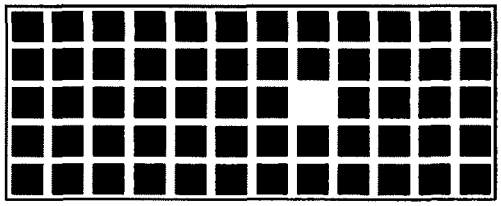
FIG. 26A is a schematic view showing an image when the periphery of the wafer has a smooth surface.
Figure 26B:
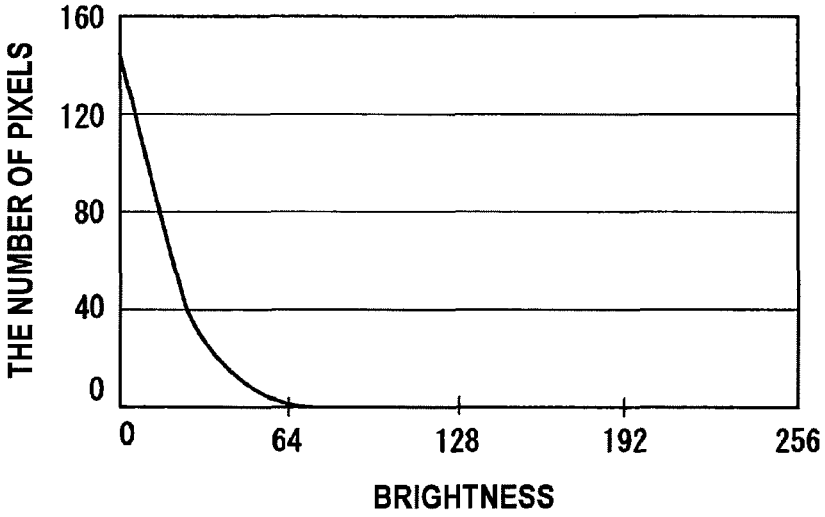
FIG. 26B is a histogram numerically expressing the image shown in FIG. 26A.

FIG. 26A is a schematic diagram showing an image when the periphery of the wafer has a smooth surface, and FIG. 26B is a histogram numerically expressing the image shown in FIG. 26A. As shown in FIG. 26A, when the polished surface of the wafer W is smooth, almost no white spot indicative of surface irregularities appears in the image. As a result, the increased number of pixels with low brightness appears on the histogram. Therefore, when the number of pixels in a predetermined brightness range increases above a preset value (e.g., when the number of pixels having a brightness in the range of 0 to 64 exceeds 1000) or decreases below a preset value (e.g., when the number of pixels having a brightness of 64 or more falls below 10), the image processor 62 can judge that the surface of the periphery of the wafer becomes smooth. For increasing the accuracy of the judgement, the image processor 62 may judge that the surface of the periphery of the wafer is smooth when a period of time in which the number of pixels in the predetermined brightness range is greater than the preset value or smaller than the preset value exceeds a predetermined period of time.

Figure 27:
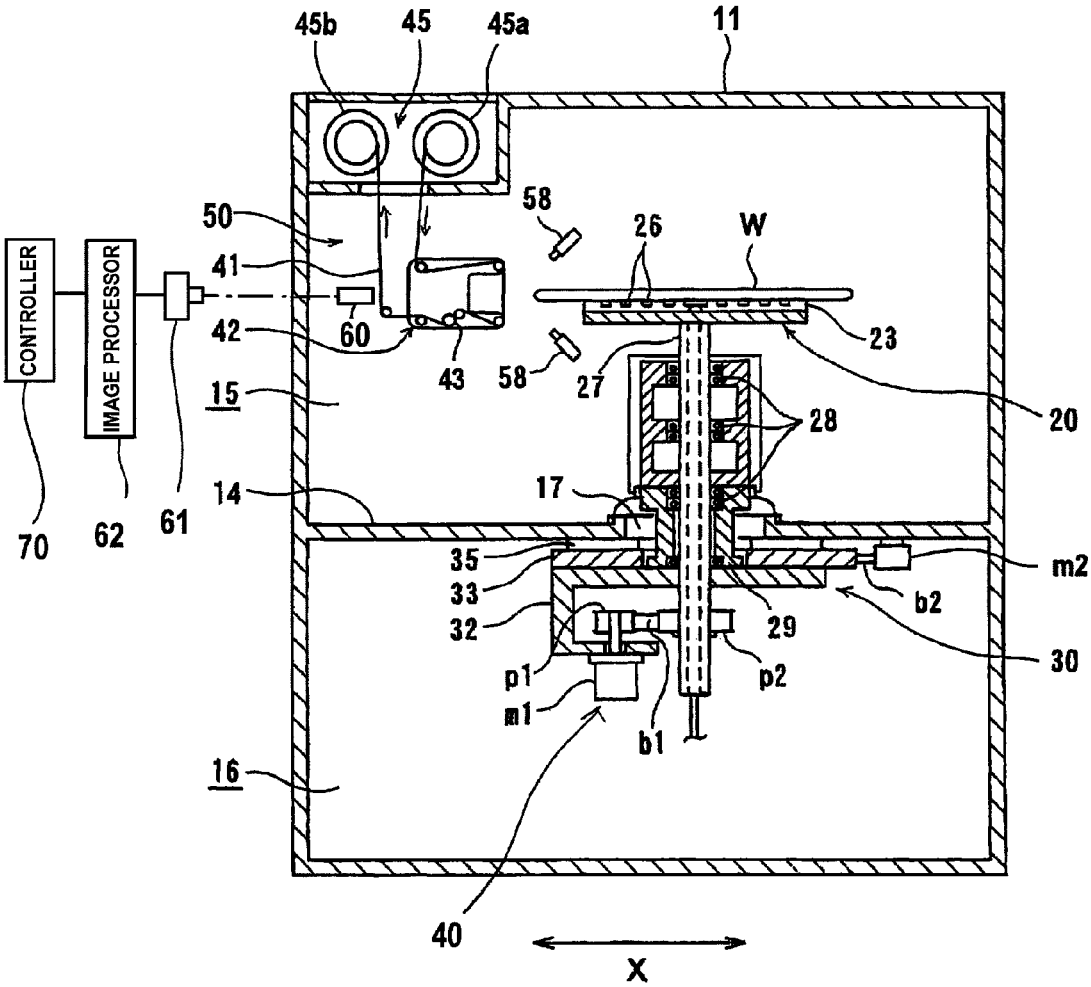
FIG. 27 is a view showing a polishing apparatus according to a seventh embodiment of the present invention.

FIG. 27 is a view showing a polishing apparatus according to a seventh embodiment of the present invention. Structural details of the present embodiment, which will not be described, are identical to those of the first embodiment described above, and repetitive description thereof will be omitted.

As shown in FIG. 27, the terminal imaging element 60 is disposed behind the polishing head 42 so as to face the polishing surface of the polishing tape 41. The CCD camera 61 captures through the terminal imaging element 60 an image of the polishing surface of the polishing tape 41 that has contacted the wafer W. The image processor 62 analyzes the captured image of the polishing surface, and monitors a polished state of the wafer W and an operating state of the polishing apparatus based on size, shape, and color (shade) of polishing marks appearing on the polishing surface.

In the first through seventh embodiments, the polishing head is of a so-called open-reel type wherein the polishing head is tiltable with respect to the wafer W. The present invention is not limited to the illustrated type, and is also applicable to a polishing type in which a polishing head is fixed in position.

An image spectroscope may be disposed between the terminal imaging element and the image-capturing device for obtaining an optical spectrum of an image of the periphery of the wafer, and the image processor may detect a polishing end point by analyzing the optical spectrum.

The previous description of embodiments is provided to enable a person skilled in the art to make and use the present invention. Therefore, the present invention is not limited to the above-described embodiments. It should be understood that various changes and modifications may be made without departing from the scope of claims for patent and the scope of the technical concept described in the specification and drawings.

INDUSTRIAL APPLICABILITY

The present invention is applicable to a polishing apparatus for polishing a periphery of a substrate, such as a semiconductor wafer.

The invention claimed is:

1. A polishing apparatus, comprising:

a stage configured to hold a substrate;

a stage-rotating mechanism configured to rotate said stage;

a polishing head configured to polish a periphery of the substrate held by said stage;

a controller configured to control operations of said stage, said stage-rotating mechanism, and said polishing head;

an image-capturing device configured to capture an image of the periphery of the substrate through at least one terminal imaging element arranged so as to face the periphery of the substrate;

an image processor configured to process the image captured by said image-capturing device; and a contact head configured to bring a transparent tape into contact with the periphery of the substrate, the transparent tape being arranged between the periphery of the substrate and said terminal imaging element and having a light-transmissive property, wherein said terminal imaging element is arranged so as to face a portion of the transparent tape where highest contact pressure is applied to the periphery of the substrate.

2. A polishing apparatus, comprising:

a stage configured to hold a substrate;

a stage-rotating mechanism configured to rotate said stage;

a polishing head configured to polish a periphery of the substrate held by said stage;

a controller configured to control operations of said stage, said stage-rotating mechanism, and said polishing head;

an image-capturing device configured to capture an image of the periphery of the substrate through at least one terminal imaging element arranged so as to face the periphery of the substrate;

an image processor configured to process the image captured by said image-capturing device; and a contact head configured to bring a contact member into contact with the periphery of the substrate, the contact member being arranged between the periphery of the substrate and said terminal imaging element and having a light-transmissive property, wherein said terminal imaging element and said contact head are configured to be tiltable with respect to a surface of the substrate held by said stage.

3. The polishing apparatus according to claim 1, wherein said contact head includes a press pad arranged at a rear side of the transparent tape and a press mechanism configured to cause said press pad to press the transparent tape against the periphery of the substrate.

4. The polishing apparatus according to claim 3, further comprising:

an illuminator configured to illuminate the periphery of the substrate, wherein said terminal imaging element is arranged in a position away from a light of said illuminator reflected from the transparent tape.

5. The polishing apparatus according to claim 4, wherein said illuminator and said terminal imaging element are oriented in the same direction and are constructed integrally.

6. The polishing apparatus according to claim 3, wherein the transparent tape has a cleaning function for wiping the periphery of the substrate or a polishing function for polishing the periphery of the substrate.

7. A polishing apparatus, comprising:

a stage configured to hold a substrate;

a stage-rotating mechanism configured to rotate said stage;

a polishing head configured to polish a periphery of the substrate held by said stage;

a controller configured to control operations of said stage, said stage-rotating mechanism, and said polishing head;

an image-capturing device configured to capture an image of the periphery of the substrate through at least one terminal imaging element arranged so as to face the periphery of the substrate;

an image processor configured to process the image captured by said image-capturing device; and a contact head configured to bring a contact member into contact with the periphery of the substrate, the contact member being arranged between the periphery of the substrate and said terminal imaging element and having a light-transmissive property, wherein said image processor is configured to analyze a surface roughness of the periphery of the substrate from the image captured by said image-capturing device, express a distribution of the surface roughness as a numerical value, and judge that a polishing end point is reached when the numerical value exceeds or falls below a preset threshold value.

8. A polishing apparatus, comprising:

a stage configured to hold a substrate;

a stage-rotating mechanism configured to rotate said stage;

a polishing head configured to polish a periphery of the substrate held by said stage;

a controller configured to control operations of said stage, said stage-rotating mechanism, and said polishing head;

an image-capturing device configured to capture an image of the periphery of the substrate through at least one terminal imaging element arranged so as to face the periphery of the substrate;

an image processor configured to process the image captured by said image-capturing device; and a contact head configured to bring a contact member into contact with the periphery of the substrate, the contact member being arranged between the periphery of the substrate and said terminal imaging element and having a light-transmissive property, wherein said image processor is configured to express as a numerical value a color of the image captured by said image-capturing device, and judge that a polishing end point is reached when the numerical value exceeds or falls below a preset threshold value.

* * * * *